US005510600A

United States Patent [19]

Jackson

[11] Patent Number: 5,510,600

[45] Date of Patent: Apr. 23, 1996

[54] ELECTROMAGNETIC INDUCTION HEATING APPARATUS FOR HEATING ELONGATED METAL WORKPIECES

[75] Inventor: William B. Jackson, South Wirral, England

[73] Assignee: EA Technology Limited, United Kingdom

[21] Appl. No.: 244,419

[22] PCT Filed: Nov. 30, 1992

[86] PCT No.: PCT/GB92/02212

§ 371 Date: May 25, 1994

§ 102(e) Date: May 25, 1994

[87] PCT Pub. No.: WO93/11650

PCT Pub. Date: Jun. 10, 1993

[30] Foreign Application Priority Data

Dec. 3, 1991 [GB] United Kingdom ..... 9125650

[51] Int. Cl.[6] ..... H05B 6/06

[52] U.S. Cl. ..... 219/645; 219/662; 219/646

[58] Field of Search ..... 219/645, 646, 219/656, 662, 670, 636

[56] References Cited

U.S. PATENT DOCUMENTS

| | | | |
|---|---|---|---|
| 2,902,572 | 9/1959 | Lackner et al. | 219/645 |
| 3,444,346 | 5/1969 | Russell et al. | 219/645 |
| 4,122,321 | 10/1978 | Cachat | 219/656 |
| 4,321,444 | 3/1982 | Davies | 219/646 |
| 4,484,048 | 11/1984 | Travers et al. | 219/645 |
| 5,055,647 | 10/1991 | Heyes et al. | 219/645 |
| 5,126,522 | 6/1992 | Katayama et al. | 219/663 |

FOREIGN PATENT DOCUMENTS

| | | |
|---|---|---|
| 2538665 | 6/1984 | France . |
| 921400 | 1/1954 | Germany . |
| 712066 | 7/1954 | United Kingdom . |
| 1546367 | 5/1979 | United Kingdom . |
| 9103916 | 3/1991 | United Kingdom . |

*Primary Examiner*—Philip H. Leung
*Attorney, Agent, or Firm*—Westman, Champlin & Kelly

[57] ABSTRACT

Induction heating apparatus for heating an elongate metal workpiece of predetermined width generates time varying magnetic fields which produce longitudinal eddy current distributions across the width of the workpiece having cosine and sine profiles. The amplitude of these profiles is not necessarily uniform across the width of the workpiece and the spatial period of these profiles across the workpiece width are chosen to ensure that the line integral across the workpiece of the eddy currents is zero. In this way a desired heating profile across the width of the workpiece can be maintained.

34 Claims, 17 Drawing Sheets

3
20
1
5
2
y
0
x
z
MMF
A

21
λ
x
22
$J_0$
$A.m^{-2}$

0
λ/2
λ
2λ
x
POWER
$W.m^{-3}$

0
λ/2
λ
2λ
x 1
3
20
4
5
2
MMF
A

0
λ/2
λ
2λ
x
y
0
x
z
J0
A.m-2

0
λ/2
λ
2λ
x
POWER
W.m-3

0
λ
2λ
x 25
23
24
5
a b c c b' a'd e f f' e' d'
26

AIR-GAP MMF OF ▨ WINDING
$J_z$ COS

AIR-GAP MMF OF ⊕ WINDING
$J_z$ SIN a b c c' b' a'd e f f' e' d'
FINISH a b f c d e
START
FINISH

ELECTROMAGNETIC INDUCTION HEATING APPARATUS FOR HEATING ELONGATED METAL WORKPIECES

This invention relates to induction heating apparatus, particularly for heating elongate metal workpieces of uniform width. GB-A-1546367 discloses such an apparatus in which magnetic pole pieces extend transversely of the length of the workpiece the associated windings being energised from an alternating current supply. A difficulty which arises with induction heating apparatus is obtaining a uniform temperature profile across the width of the workpiece being heated. In the prior art, attempts to obtain such a uniform temperature profile have involved seeking to control the flux density produced per unit width across the workpiece. In GB-A-1546367, flux per unit width is controlled by appropriate shaping, construction or arrangement of the pole pieces, or by the use of appendages attached to these pole pieces.

An alternative form of induction heating apparatus that has been proposed is described in GB-A-712066. Here the magnetic pole pieces extend longitudinally along the length of the workpiece, so that currents are induced in the major surfaces of the workpiece flowing longitudinally rather than transversely across the width. This arrangement can assist in avoiding the heat distortions caused by transversely flowing current loops being completed by longitudinal currents at the workpiece edges. However, longitudinally extending pole pieces imply alternative magnetic poles across the width of the workpiece, in turn implying a periodic distribution of longitudinal eddy currents across the width. Clearly, such a periodic spatial distribution of eddy current can result in a corresponding variation in heating effect over the workpiece width.

GB-A-712066 suggests that this may not be a problem provided the spacing between adjacent magnetic poles across the workpiece width is sufficiently small, e.g. 1 to 2 cms. However, the magnetic efficiency of such an arrangement would be very low due to these small magnetic pole spacings. This prior art specification does also propose an arrangement in which "it is not even necessary to use particularly small pole pitches" in which the width of the workpiece is equal substantially exactly to an even number of magnetic pole pitches. Then it is stated that a completely uniform heating across the width of the strip can be obtained by energising the windings of the inductor to provide both sine and cosine magnetic field distributions across the width of the workpiece. This is achieved either by energising the windings at two different frequencies, or at the same frequency but in phase quadrature.

It is believed that no practical apparatus has every resulted from the concepts disclosed in GB-A-712066 for the following reasons. The simple winding arrangements disclosed in the examples do not adequately control the generation of eddy currents in the workpiece to have the required sine and cosine profiles across the workpiece width. No account is taken in this prior art specification of the effect of the edges of the workpiece which provide discontinuities which effect the magnetic field distribution. Most fundamentally, it is seldom in practice required to produce precisely uniform heat input across the width of a workpiece. Especially if the workpiece has significant thickness, there can be increased heat loss from the edges so that it may be desired to slightly increase heat input at the edges. Also, induction heating apparatus is commonly employed for heating continuous strip and there is difficulty in maintaining uniform heat input across the width of a strip as it enters the heating apparatus and as it leaves. This non-uniform heating at the ends of the apparatus can be compensated by an appropriate degree of non-uniformity of heat input as the workpiece travels along the length of the apparatus.

As will become more apparent later herein, the arrangement disclosed in GB-A-712066 cannot be used to produce a desired non-uniformity of heat input across the width of the workpiece, even ignoring edge effects.

According to one aspect of the present invention, there is provided induction heating apparatus for heating an elongate metal workpiece of predetermined width w comprising means to generate time varying magnetic fields having magnitudes with spatial profiles across the width w of the workpiece which respectively correspond to time averaged longitudinal eddy currents in the workpiece having distributions across the width of the workpiece which are substantially:

$$J(x)\ \mathrm{Cos}\ \phi(x) \text{ and } \sqrt{\kappa}J(x)\ \mathrm{Sin}\ \phi(x)$$

where x is the distance across the width of the workpiece from the centre line,

J(x) is proportional to the magnitude of induced current density in the workpiece at a distance x from the centre line required to produce a desired profile P(x) across the width w of heat energy generated in the workpiece, κ is the ratio of the time for which said field corresponding to said sine eddy current distribution is generated relative to the time for which said field corresponding to said cosine eddy current distribution is generated, and φ(x) is a function of x selected such that in substance $$\int_{-w/2}^{w/2} J(x)e^{j\phi(x)}dx = 0;$$

wherein said magnetic field generating means is arranged for generating said fields with said corresponding eddy current distributions when J is non-uniform.

When the fields corresponding to the cosine and sine eddy current distributions are generated simultaneously, κ=1 and J(x) is equal to said magnitude of induced current density required to produce heating profile P(x). When said fields are generated alternately, J(x) is $1/\sqrt{(\kappa+1)}$ times said magnitude.

The integral equation in the above statement in fact expresses the requirement that the integral of the current density across the width of the workpiece must be zero for both the cosine component and the sine component. The amplitude J(x) of the cosine eddy current spatial distributions is selected to be a function of x to produce the desired profile P(x) of heating energy generated in the workpiece ($P \propto J^2$). As will be better understood later herein, selection of a non-uniform J puts constraints on the selection of the function φ(x) so that the integral equation can still be satisfied.

In practice, it is clear that for any magnetic field profile across the width of the workpiece, the integral across the width of longitudinally flowing eddy currents must be zero. However, without careful selection of the function φ, it is impossible to produce eddy current distributions in the form J Cosφ and $\sqrt{\kappa}$J Sinφ, as required.

In the present invention, the magnetic field generating means is arranged to enable appropriate fields to be generated to produce the required eddy current distributions even when J is non-uniform, i.e. varies with X.

For a better understanding of the principles of the present invention, reference should be made to the description and the accompanying drawings.

The component sine and cosine longitudinal eddy current distributions can be achieved by means of magnetic fields generated in various ways. In one embodiment, said magnetic field generating means generates said respective fields simultaneously at different energising frequencies. Then, two static field distributions can be produced with corresponding cosine and sine eddy current distributions as required.

Instead, said magnetic field generating means may generate said respective magnetic fields simultaneously at the same energising frequency but in phase quadrature. This arrangement has the effect of producing a sinusoidal waveform travelling across the width of the workpiece.

In another arrangement, said magnetic field generating means may generate said respective fields successively in time. Then the possibility of interaction between the two field components is avoided. Provided the successive field and corresponding eddy current distributions alternate in time sufficiently quickly, the time averaged heating effect within the workpiece is substantially uniform, or at least has the desired profile P. It should be understood that this successive or alternating field generating arrangement can include generating the two component fields for respective different periods of time with the ratio $\kappa$ whereupon the magnitude of each component field is altered accordingly to provide a ratio $\sqrt{\kappa}$. Thus, the field producing the cosine current distribution may have a lesser magnitude but be generated for a longer period of time relative to the field producing the sine current distribution.

With the above described arrangements for generating the component magnetic fields, said magnetic field generating means may generate said respective magnetic fields over the same region of a workpiece.

Alternatively, said magnetic field generating means may generate said respective magnetic field simultaneously at the same energising frequency and phase, but over spaced apart regions of a workpiece so that said fields do not interact. Then the mean heating profile P can still be produced in the workpiece with sufficient thermal conduction within the body of the workpiece, or where the workpiece travels so that each part of the workpiece travels from one region to the other so as successively to experience both magnetic field components.

In one embodiment for heating a workpiece of sufficient thickness that magnetic fields in opposite broad faces do not interact, both of said respective fields are generated over one broad face of said workpiece and said magnetic field generating means is arranged to generate corresponding further said respective fields over the other broad face of said workpiece at the same location along the length of the workpiece, said corresponding further fields being generated simultaneously with said respective fields over the one face to produce corresponding eddy current distributions across the width of the workpiece which are in time antiphase to the eddy currents produced in said one face. By this arrangement longitudinal eddy currents at a particular location x across the width of the workpiece flow in one direction on one face of the workpiece and in the opposite direction (with the same magnitude) in the other face. Then, heating distortions in the workpiece at each end of the heating apparatus can be reduced as eddy currents can flow through the thickness of a workpiece between the two broad faces.

In a preferred example where the two magnetic field components are generated simultaneously at different locations on the workpiece, these locations may be longitudinally spaced along the workpiece. Alternatively, these regions may be on opposite sides of a workpiece of sufficient thickness that the fields do not interact. The first above mentioned case is especially convenient when the apparatus includes transport means for moving a workpiece lengthwise past said magnetic field generating means.

Preferably, said magnetic field generating means comprises electric current conductors aligned to be longitudinal relative to the workpiece and arranged in a parallel array across the workpiece width and means for selectively connecting said conductors to a source of time varying current whereby the current in the conductors is selected to produce said magnetic fields. The said selectively connecting means may be arranged for connecting selected said conductors in series. Desirably, said selectively connecting means is arranged for connecting together corresponding ends of selected pairs of said conductors to form respective single coil windings. In this way the coil pitch i.e. distance between the forward and return conductors of each single winding can be adjusted and selected.

Preferably also, said means for selectively connecting may include adjustment means for adjusting the relative currents arranged to flow in the conductors. This facility assists in appropriately profiling the magnetic fields generated by the conductors to satisfy the above stated heating profile requirements for a range of workpiece widths, materials etc.

Said plurality of sources of time varying current may comprise sources of different magnitude of current. Further, said plurality of sources may comprise sources of different frequency. Especially for producing travelling wavefields and current distributions, said plurality of sources may comprise sources of the same frequency but in phase quadrature.

In a further aspect of the present invention, there is provided induction heating apparatus for heating an elongate metal workpiece of predetermined width w, comprising means to generate time varying magnetic fields having magnitudes with spatial profiles across the width w of the workpiece which respectively correspond to time averaged longitudinal eddy current distributions in the workpiece having distributions across the width of the workpiece which are substantially:

$$J(x)\ \mathrm{Cos}\ \phi(x) \text{ and } \sqrt{\kappa}\ J(x)\ \mathrm{Sin}\ \phi(x)$$

where x is the distance across the width of the workpiece from the centre line,

J(x) is proportional to the magnitude of induced current density in the workpiece at a distance x from the centre line required to produce a desired profile P(x) across the width w of heat energy generated in the workpiece, $\kappa$ is the ratio of the time for which said field corresponding to said sine eddy current distribution is generated relative to the time for which said field corresponding to said cosine eddy current distribution is generated, and $\phi(x)$ is a function of x selected such that in substance $$\int_{-w/2}^{w/2} J(x)e^{j\phi(x)}dx = 0;$$

wherein said magnetic field generating means is arranged to generate said respective fields successively in time.

In a still further aspect of the present invention, there is provided induction heating apparatus for heating an elongate metal workpiece of predetermined width w, comprising means to generate time varying magnetic fields having magnitudes with spatial profiles across the width w of the workpiece which respectively correspond to time averaged longitudinal eddy current distributions in the workpiece having distributions across the width of the workpiece which are substantially:

$$J(x) \text{ Cos } \phi(x) \text{ and } J(x) \text{ Sin } \phi(x)$$

where x is the distance across the width of the workpiece from the centre line,

J(x) is the magnitude of induced current density in the workpiece at a distance x from the centre line required to produce a desired profile P(x) across the width w of heat energy generated in the workpiece, and $\phi(x)$ is a function of x selected such that in substance $$\int_{-w/2}^{w/2} J(x)e^{j\phi(x)}dx = 0;$$

wherein said magnetic field generating means is arranged to generate said respective fields simultaneously at the same energising frequency and phase, but over spaced apart regions of a workpiece so that said fields do not interact.

Appropriate ones of the aforementioned preferred embodiments and examples of the invention may be applied to the above two further aspects of the invention.

Examples illustrative of the present invention will now be described in more detail and with reference to the accompanying drawings in which:

FIG. 2(*b*) illustrates graphically the magnetic field waveform generated by the apparatus of FIG. 2(*a*);

Figures 3A, 3B, 3C, 3D:
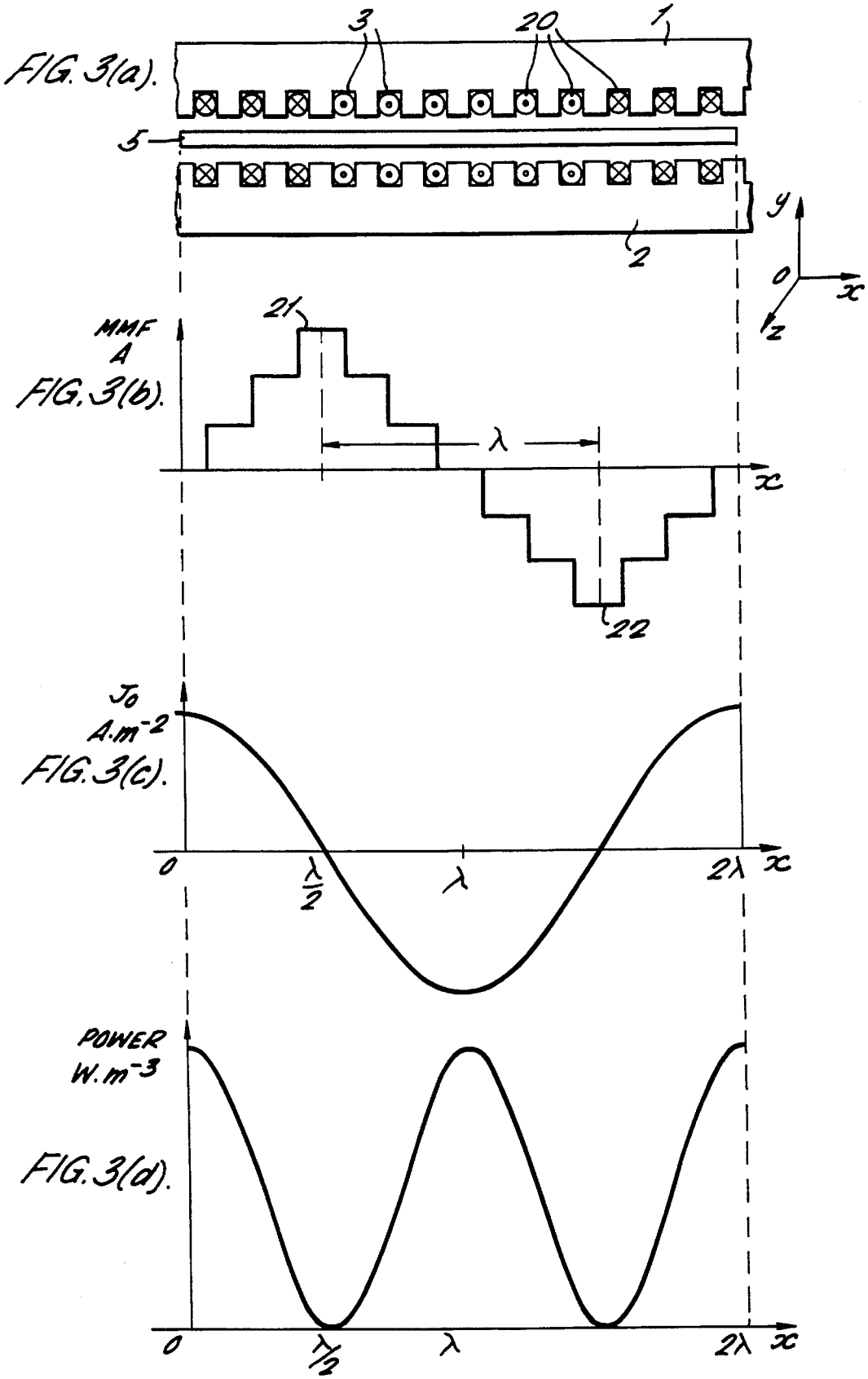
Figures 4A, 4B, 4C, 4D:
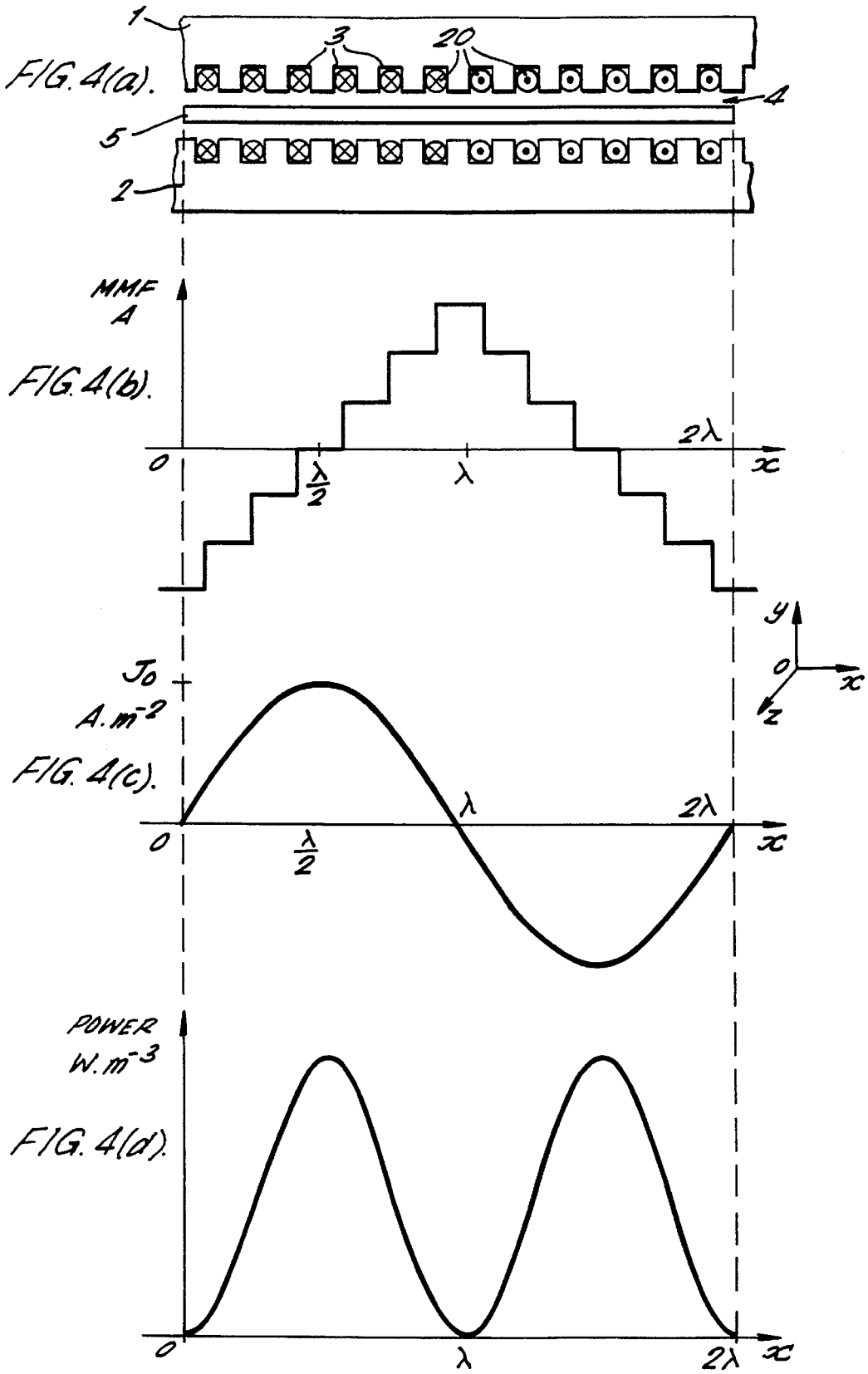
Figures 5A, 5B:
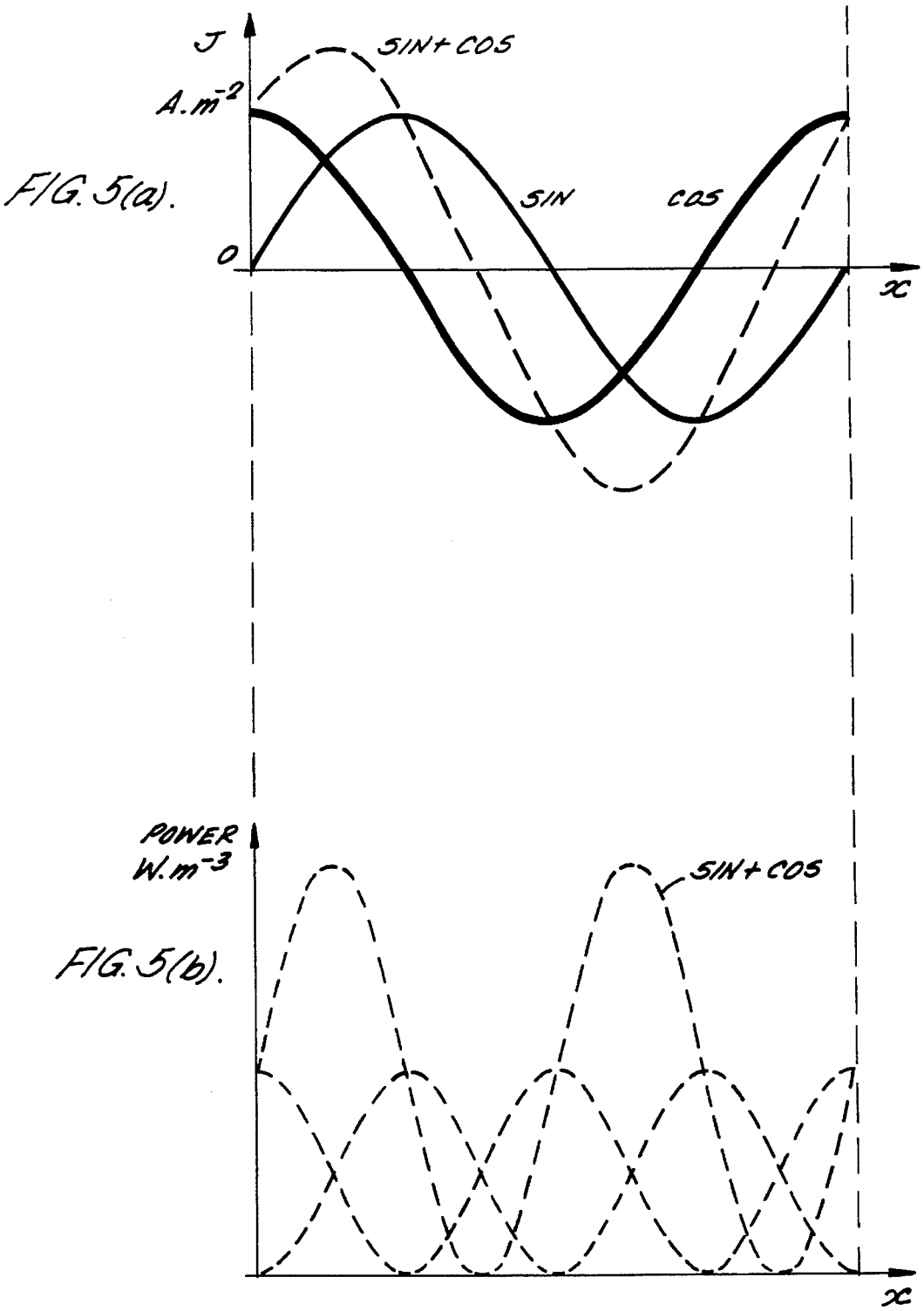
Figures 6A, 6B, 6C, 6D, 6E:
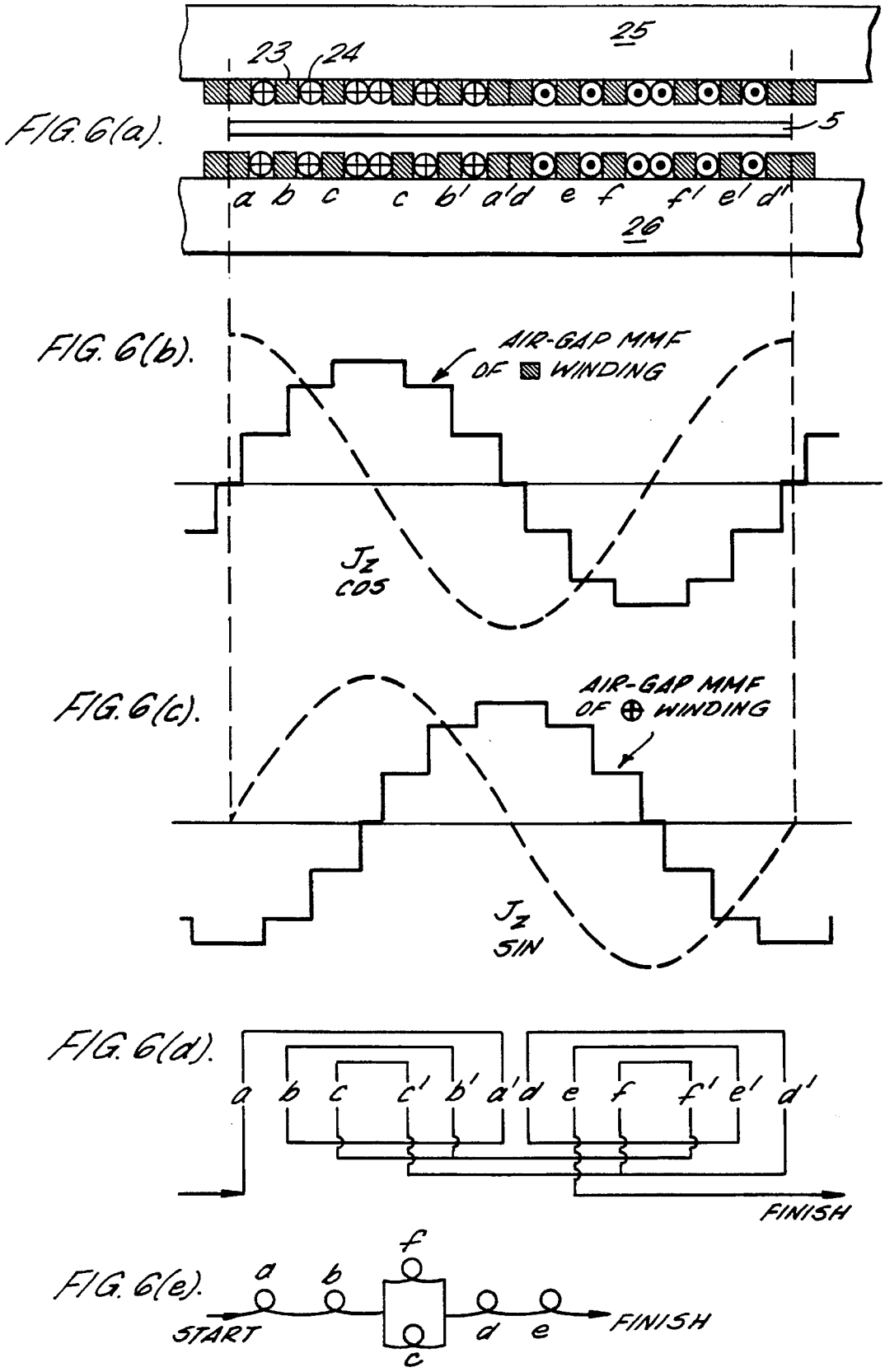
Figure 7:
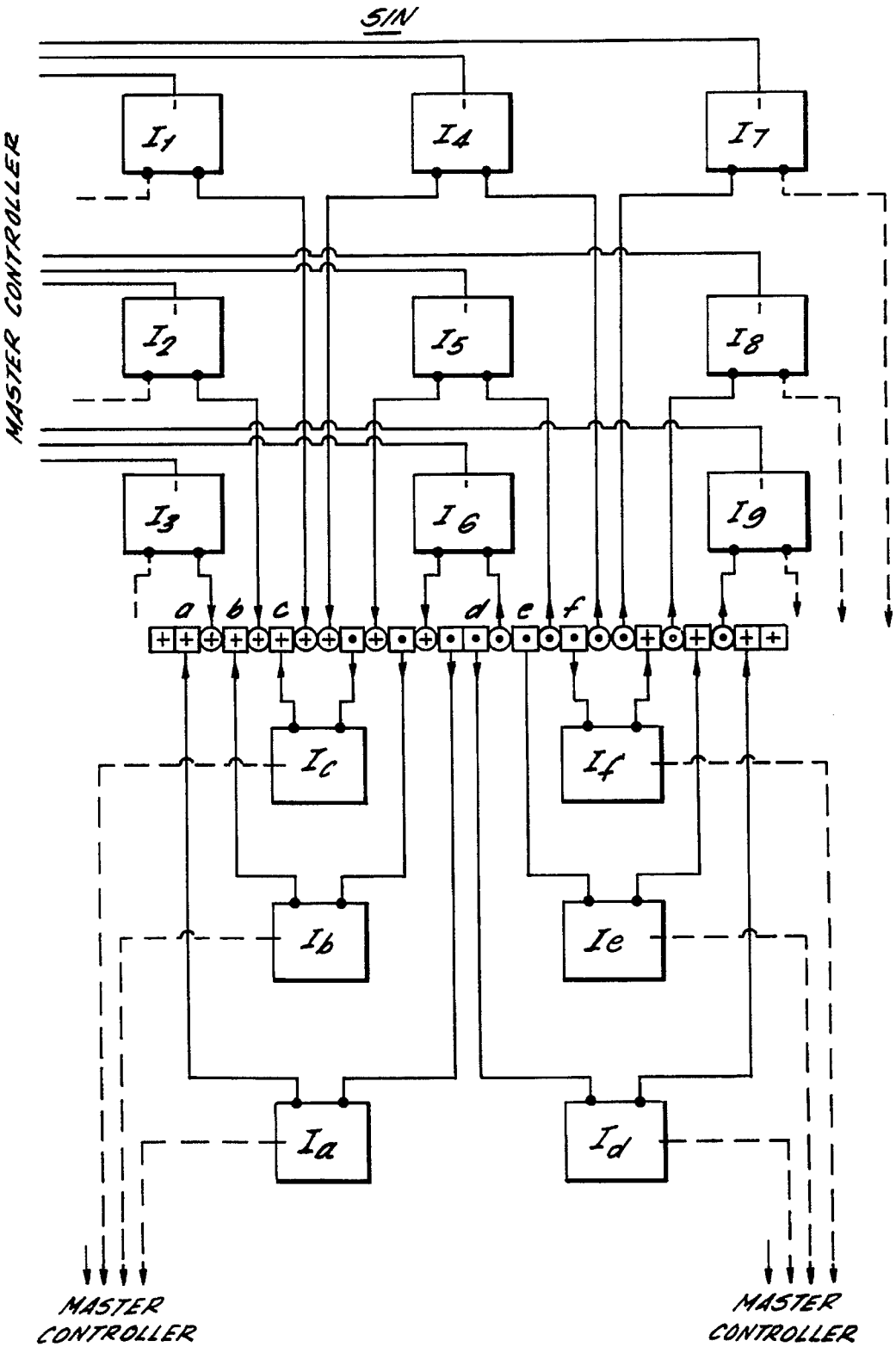
Figure 8:
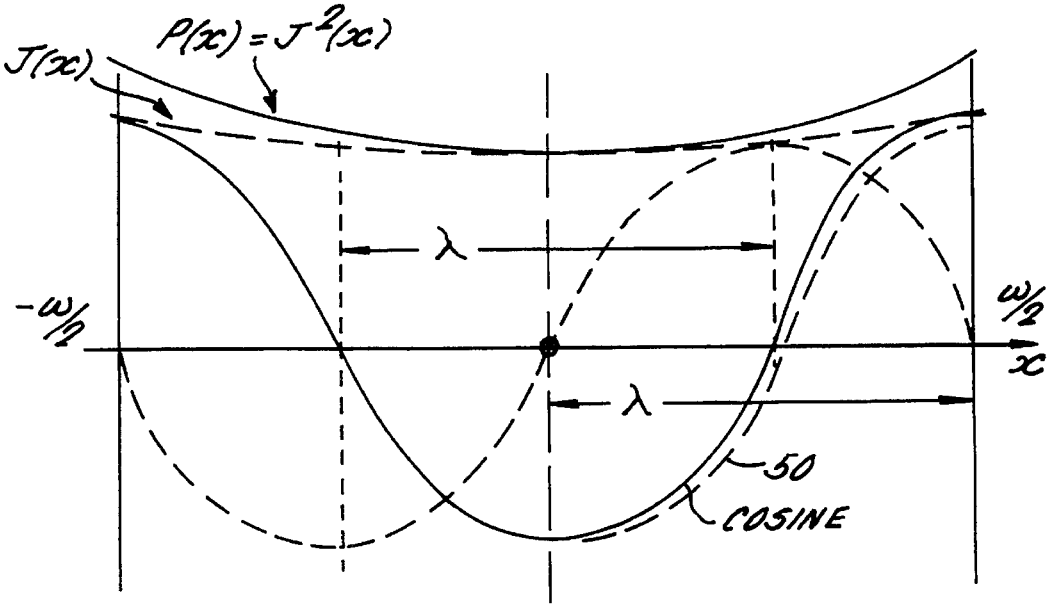
Figure 9:
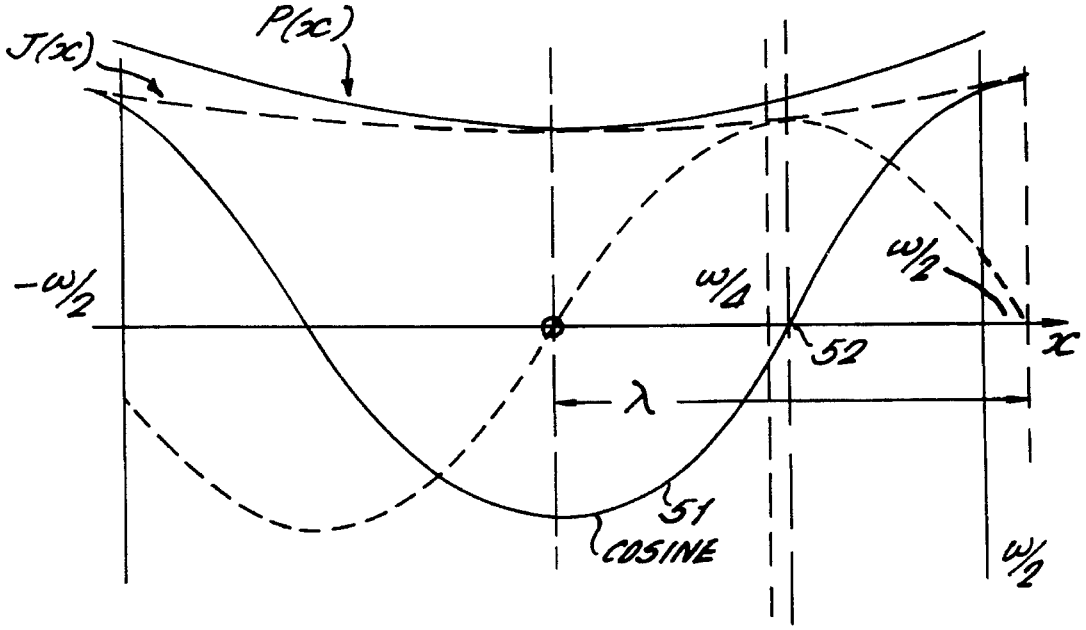
Figure 10A:
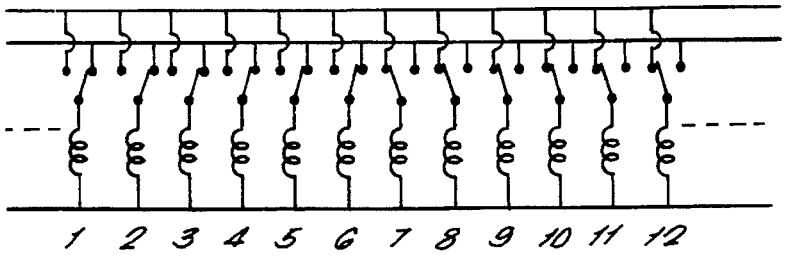
Figure 10B:
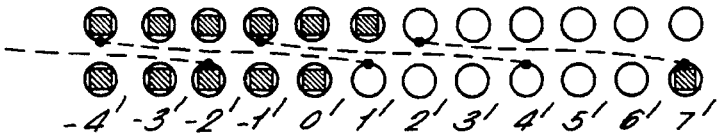
Figure 10C:
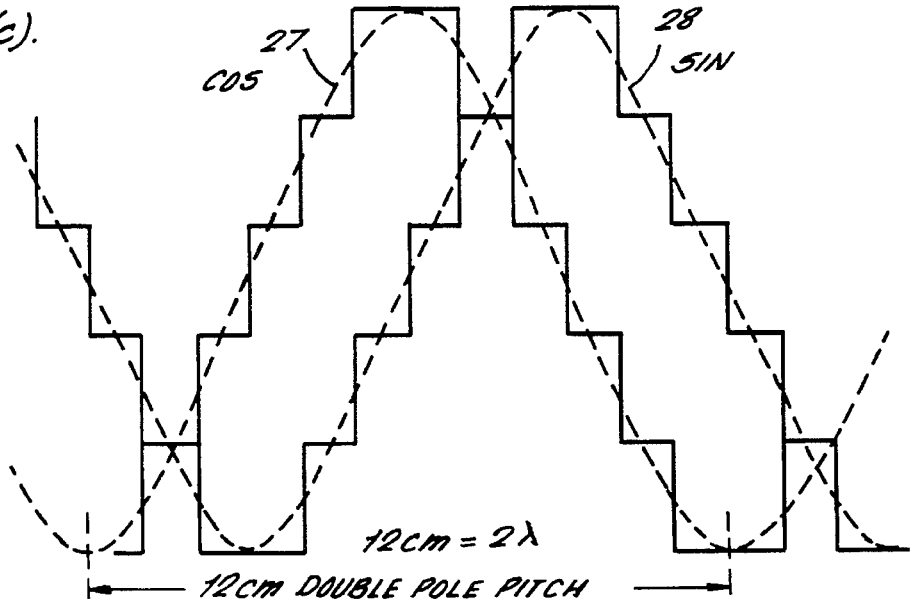
Figure 10D:
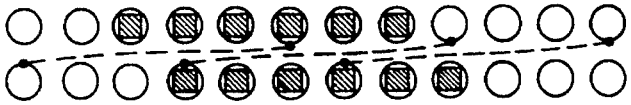
Figure 10E:
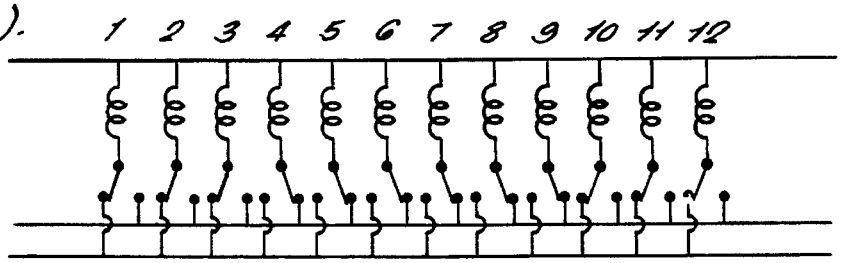
Figure 11A:
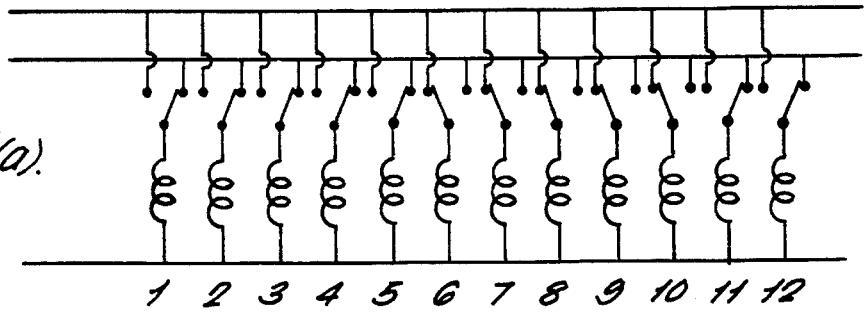
Figure 11B:
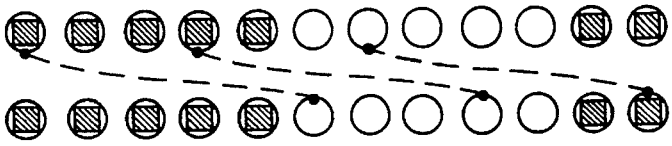
Figure 11C:
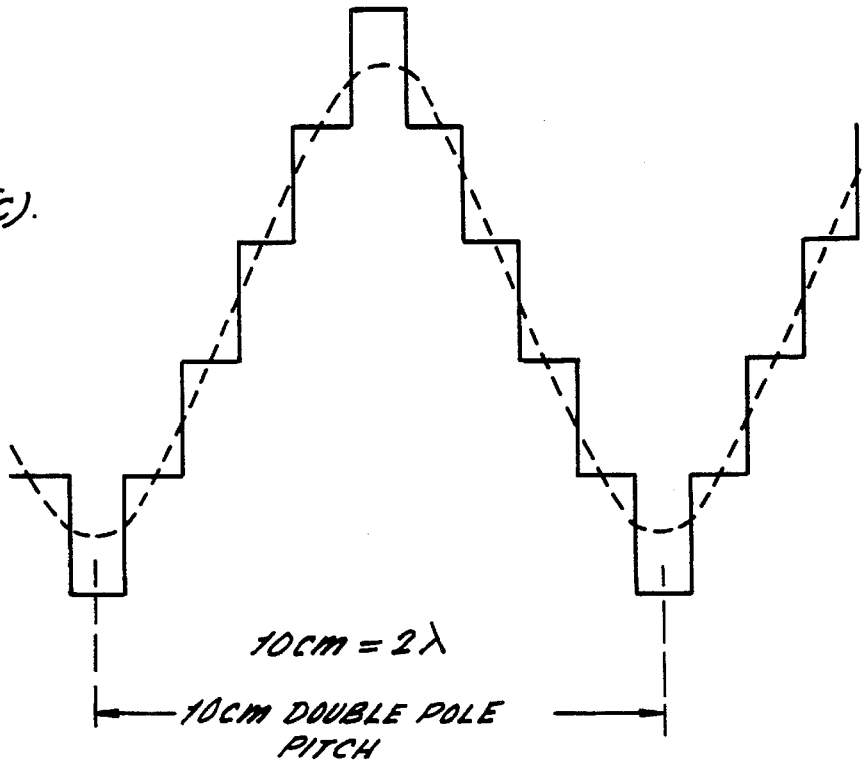
Figure 12:
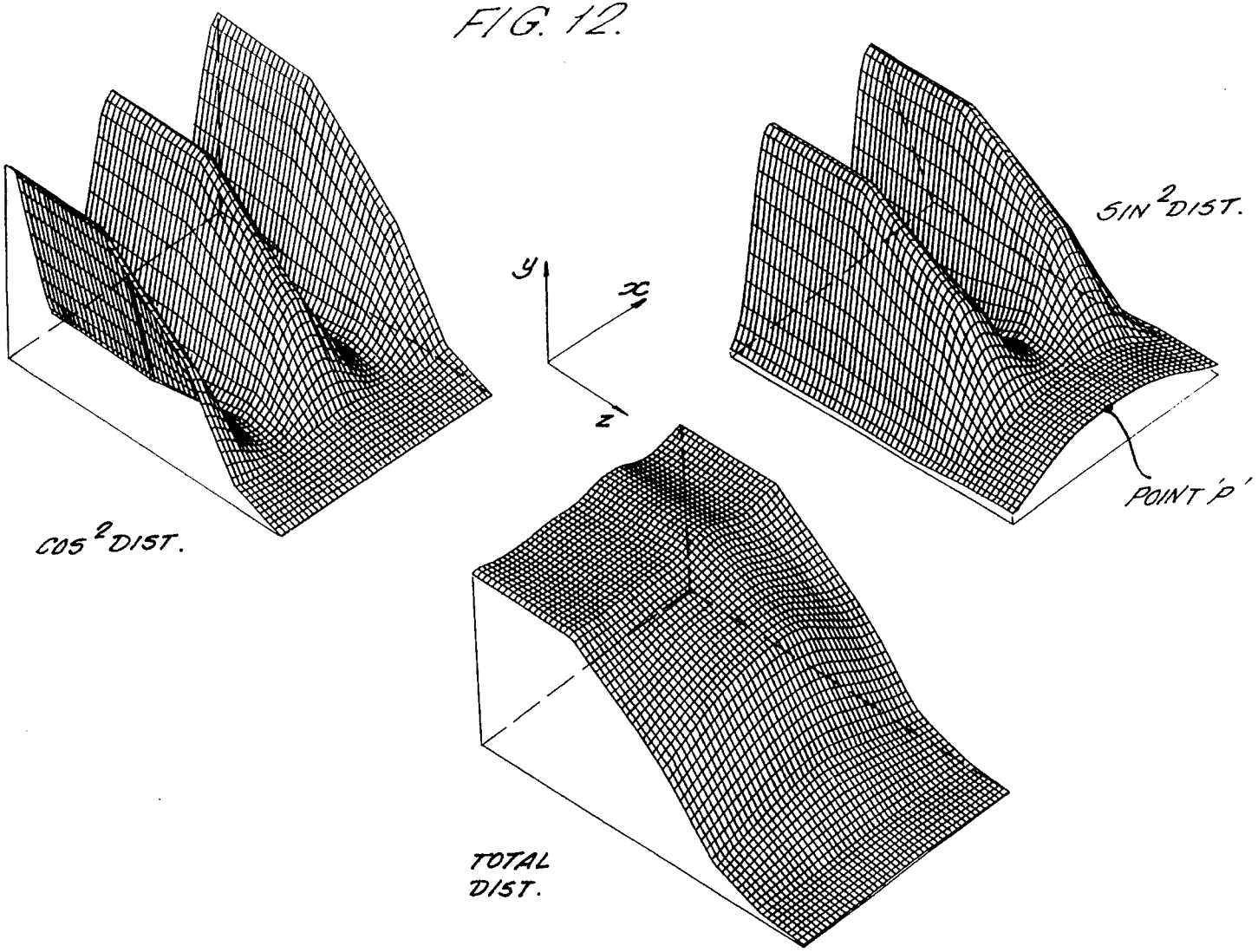
Figure 13:
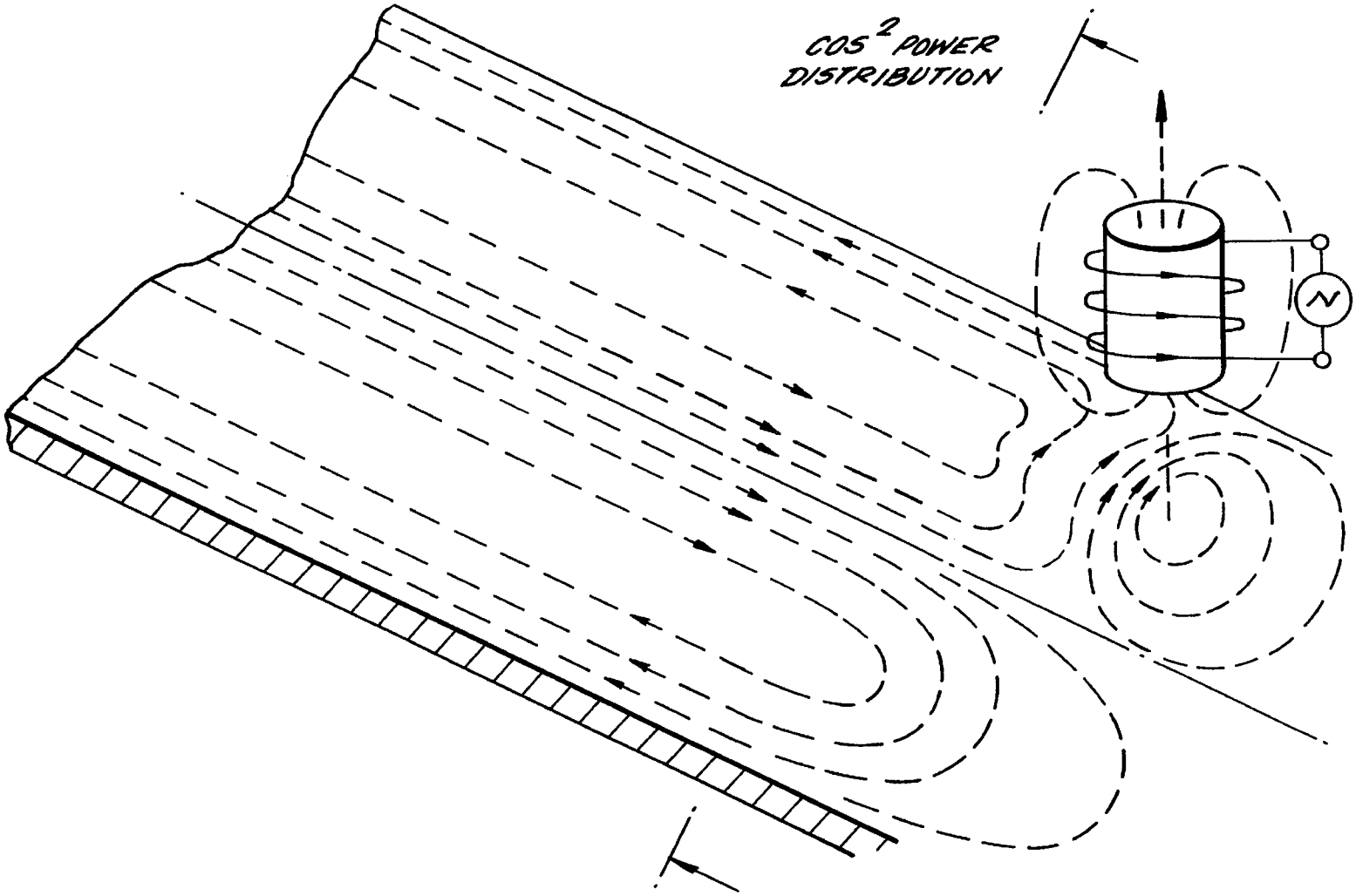
Figure 14:
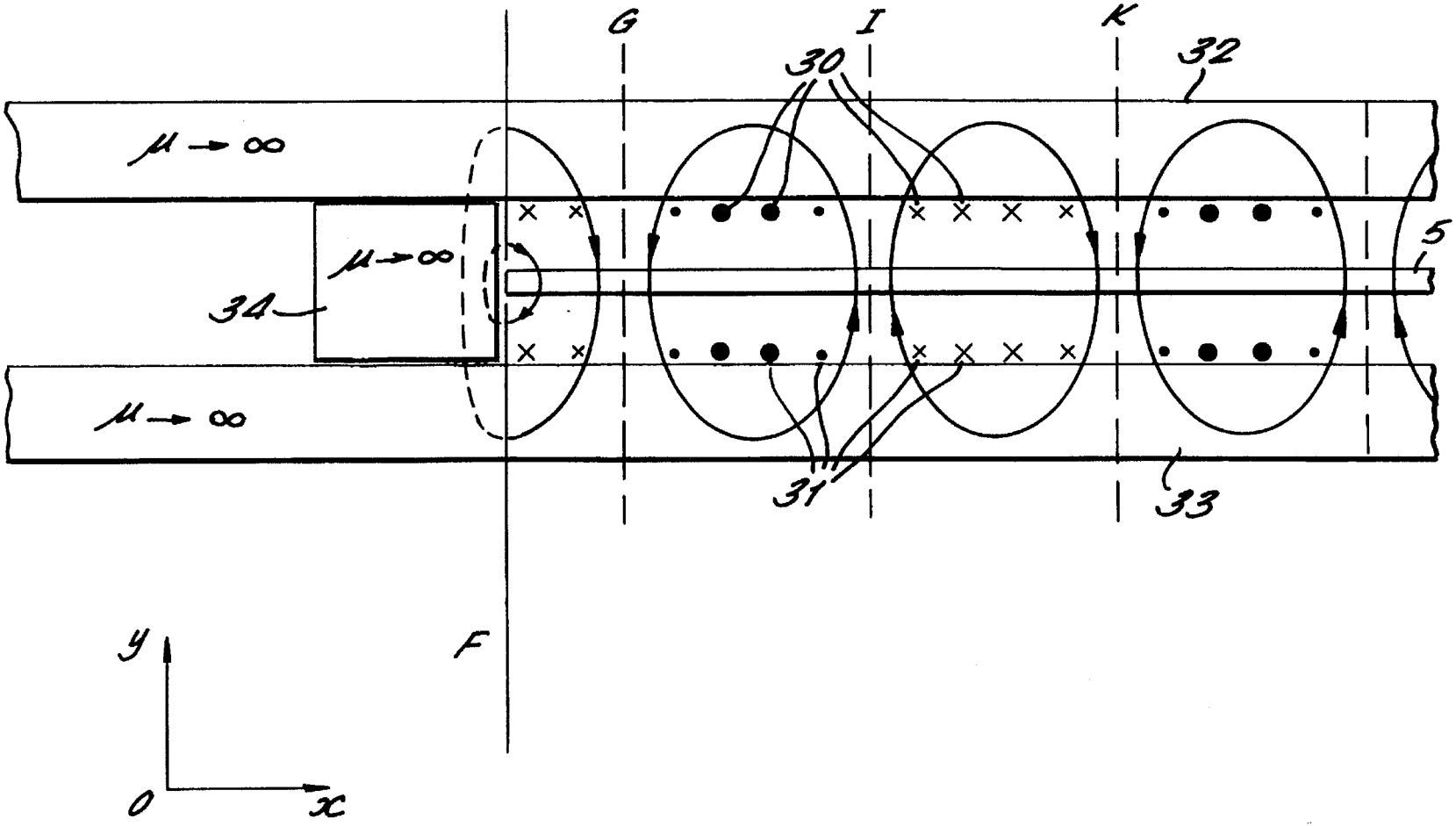
Figure 15:
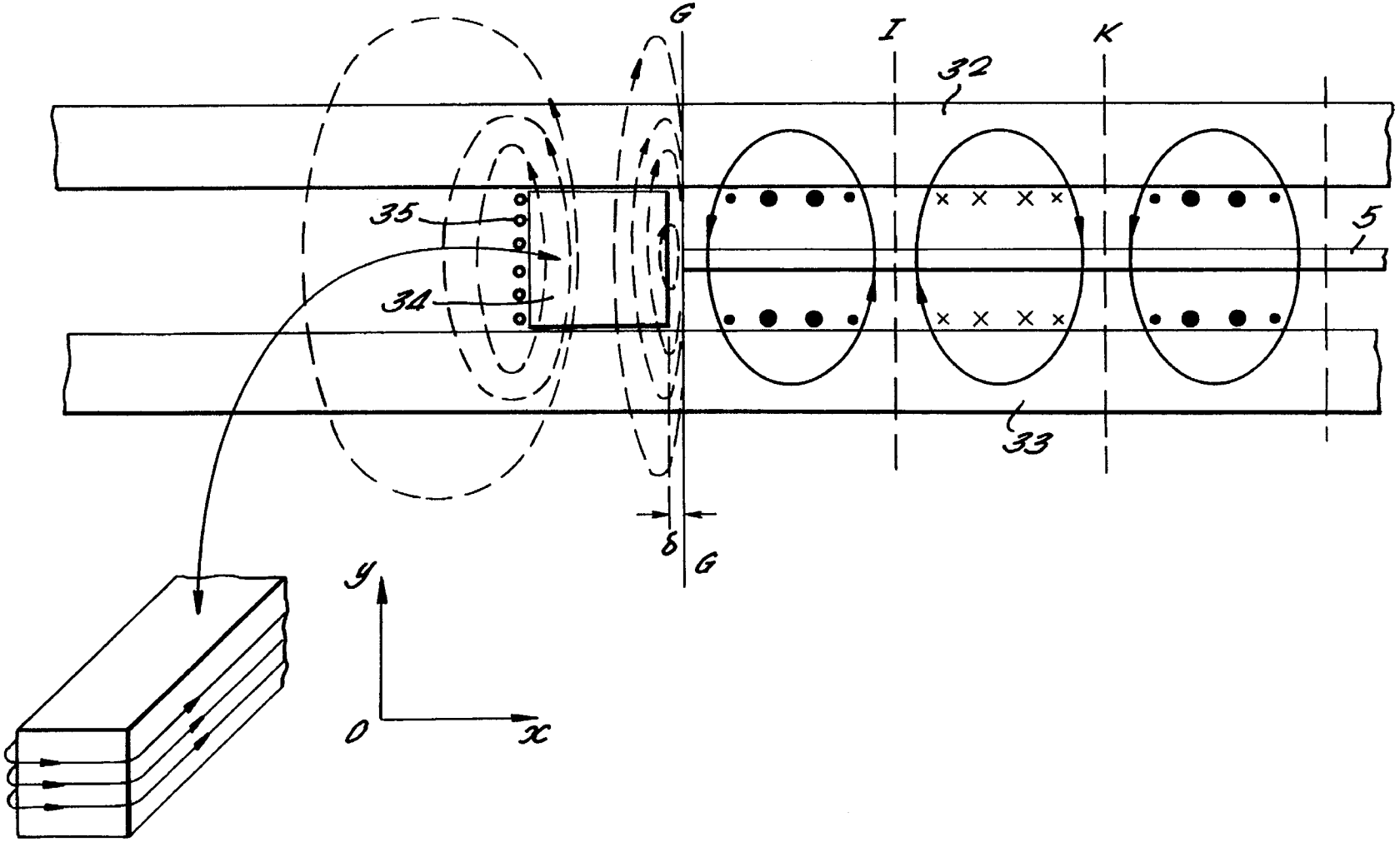
Figure 16:
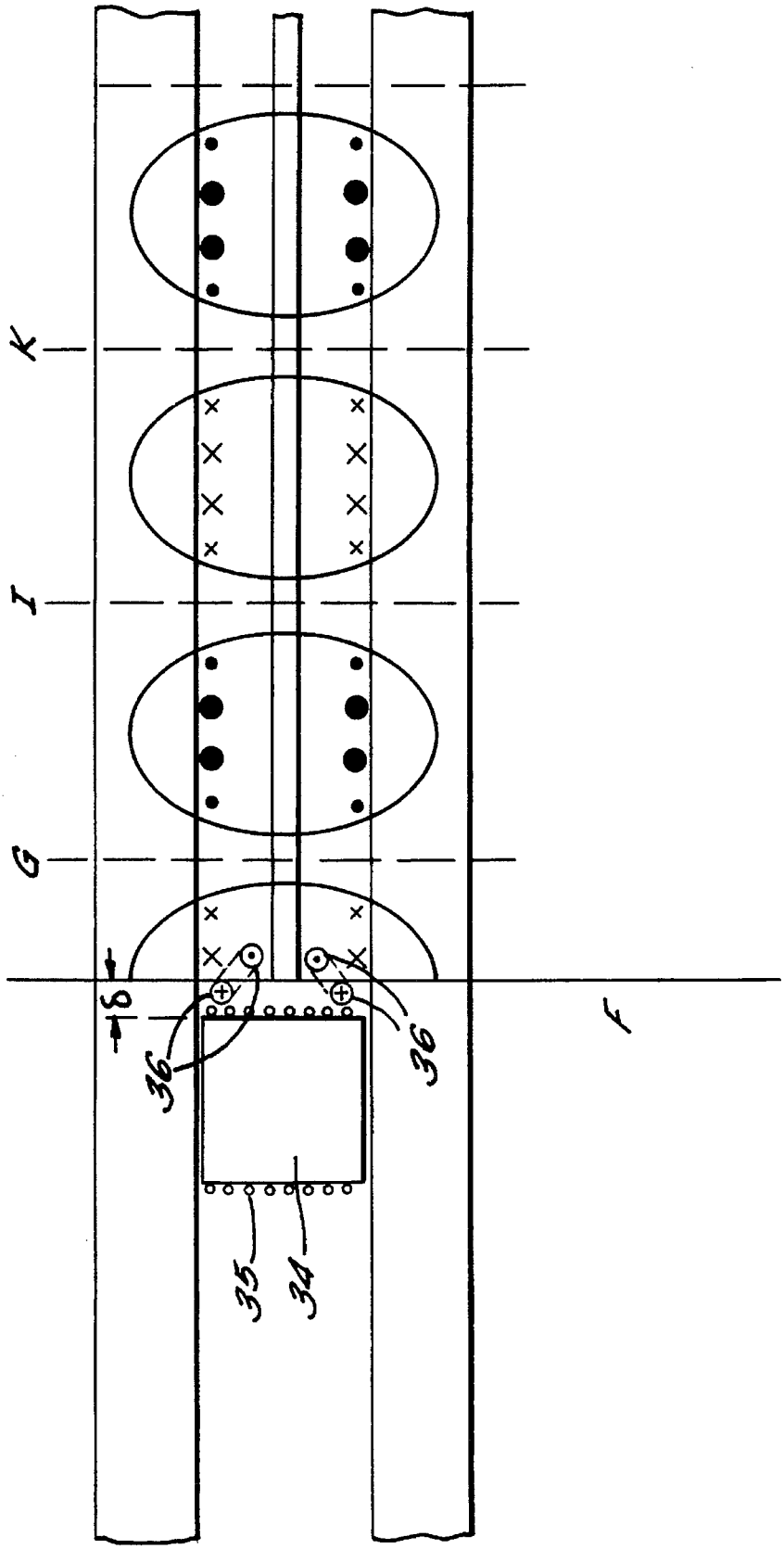
Figure 17:
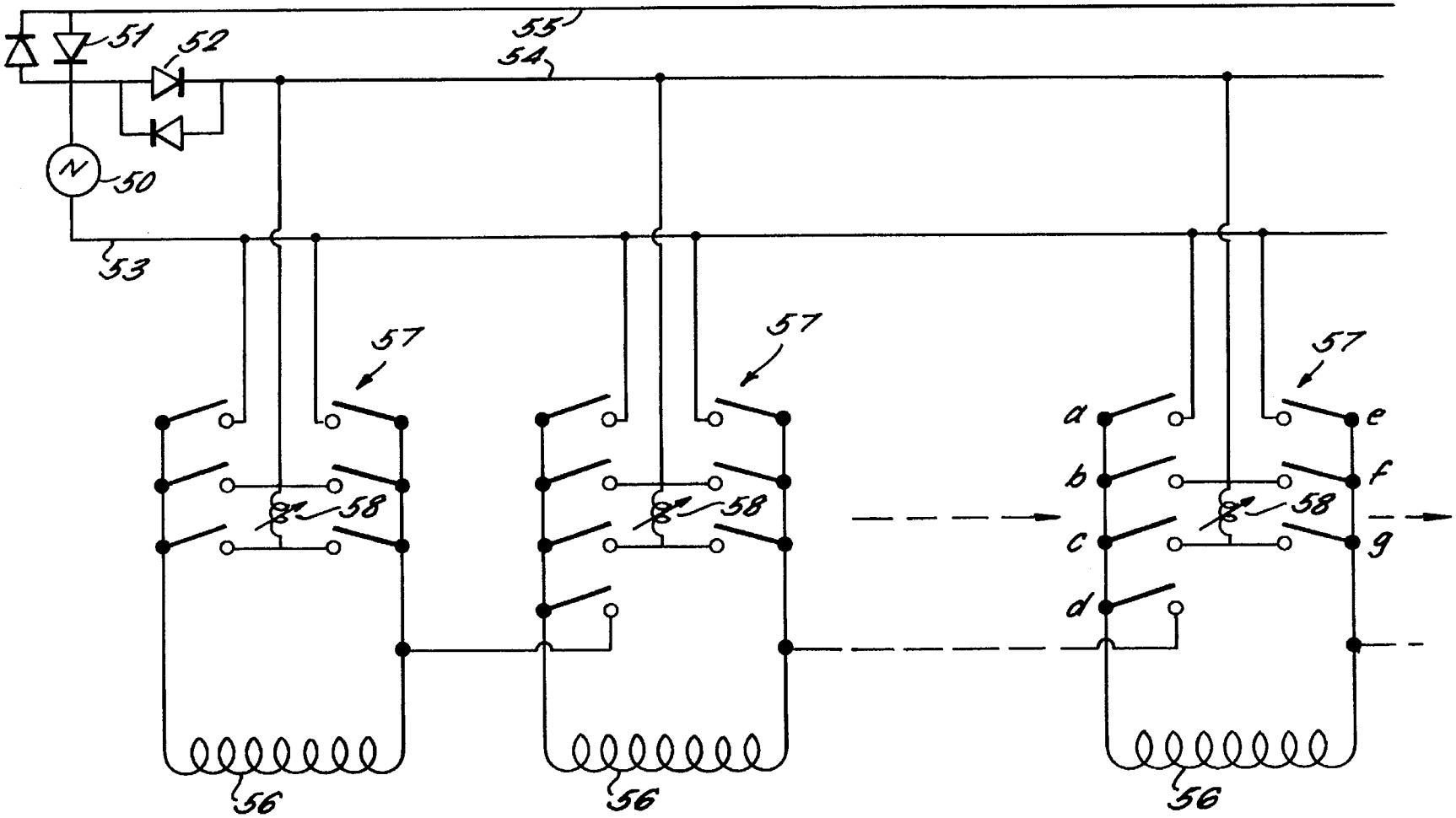
Figure 18:
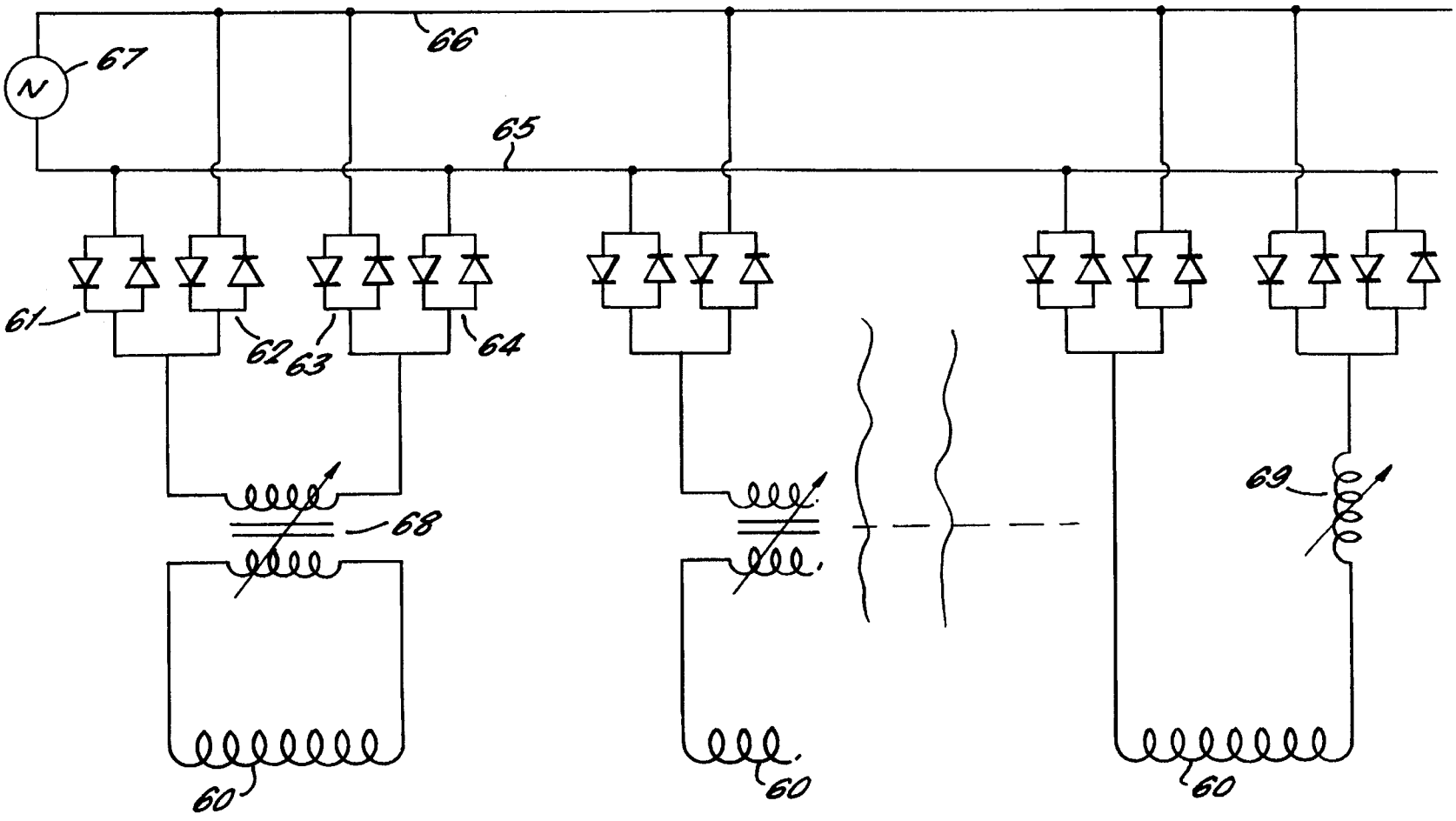

FIGS. 3(*a*) to 3(*d*) together with FIGS. 4(*a*) to 4(*d*) illustrate features of the invention in which stationary magnetic field profiles are generated;

FIGS. 5(*a*) and 5(*b*) illustrate the current and power distributions across the width of a workpiece generated by sinusoidal magnetic field distributions produced in the arrangements of FIGS. 3 and 4;

FIGS. 6(*a*) to 6(*e*) illustrate an example of the arrangement of FIGS. 3 and 4 in which separate main winding for the complementary magnetic field profiles are interleaved on the same magnetic core;

FIG. 7 illustrates a distributed power supply arrangement for energising the windings of the example of FIG. 6;

FIGS. 8 and 9 are graphical representations of current density profiles across a workpiece when it is desired to produce a non-uniform heat energy input;

FIGS. 10(*a*) to 10(*e*) illustrate another winding arrangement enabling alternate selection of sine and cosine magnetic field profiles;

FIGS. 11(*a*) to 11(*c*) illustrate how the winding arrangement of FIG. 10 can be used to adjust the magnetic field profiles to provide pole pitches of different widths;

FIG. 12 provides a graphical representation of test results for the apparatus embodying features of the invention;

FIG. 13 illustrate end effects and their correction;

FIGS. 14, 15, and 16 illustrate in greater detail edge correction arrangements; and FIGS. 17 and 18 illustrate switching and control arrangements for conductors to generate the desired magnetic field profiles.

In order fully to understand the present invention it is convenient first to describe examples of induction heating apparatus which may not themselves contain all the essential features of the present invention but serve to illustrate how the invention can be put into practice.

Figure 1:
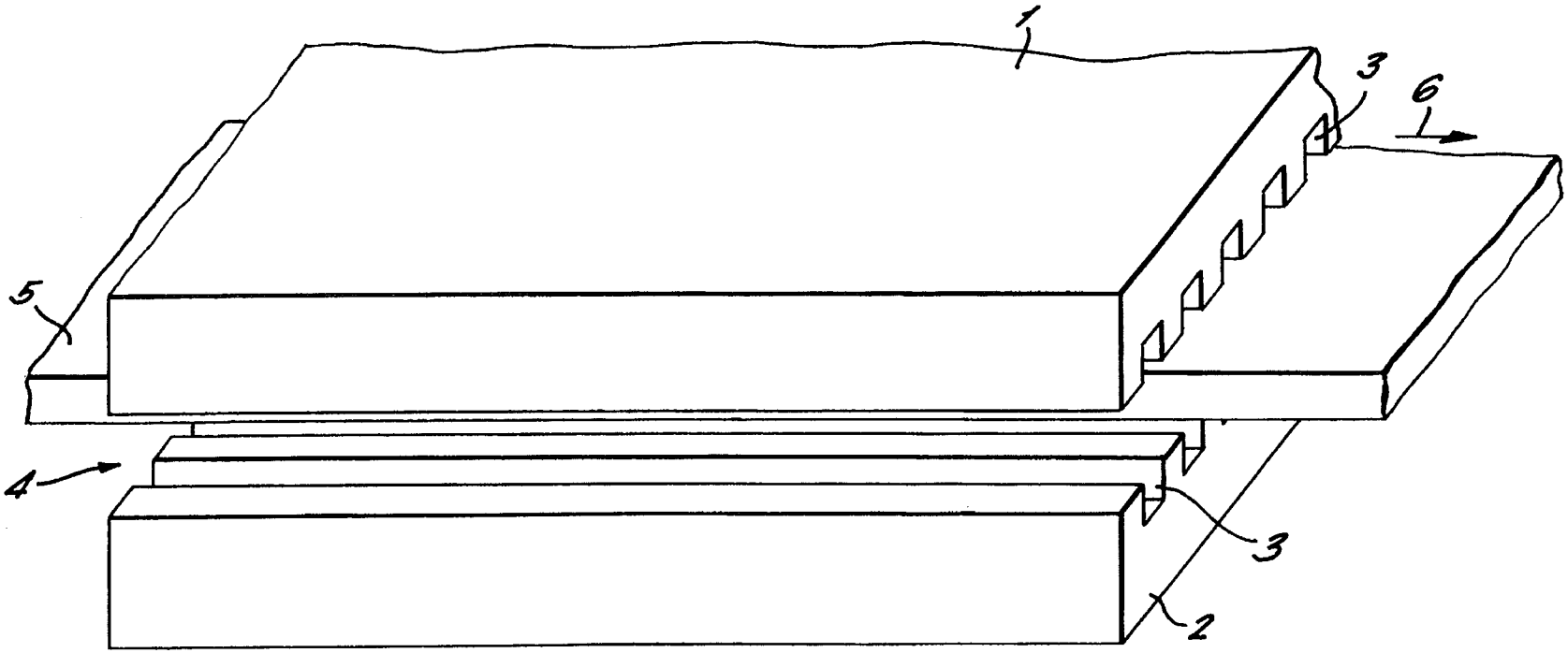
FIG. 1 is a schematic perspective view of part of an induction heating apparatus embodying features of the present invention.

Referring accordingly to FIG. 1, an induction heating apparatus is illustrated comprising upper and lower core members 1 and 2 of top and bottom inductors respectively. The inductors extend in this embodiment in substantial parallel planes and are spaced apart to define between them a gap 4 through which is passed a strip 5 of metal to be heated. The inductors include electrical windings (not shown in FIG. 1) which may be located in slots 3 formed in the opposing plane faces of the cores 1 and 2. As is known for induction heating apparatus of this general kind, the electrical windings are energised so as to generate time varying magnetic fields inducing eddy currents in the metal strip 5 resulting in resistive heating thereof. As is also normal with apparatus of this general kind, the strip being heated has usually a uniform width and may be heated whilst travelling longitudinally through the heating apparatus, e.g. in the direction of arrow 6. In alternate arrangements, e.g. for slab heating, a complete length of slab may be contained in apparatus of this general kind whilst stationary between inductors of sufficient length.

It should be noted that the windings on the cores 1 and 2 are arranged to provide time varying magnetic fields having a magnitude which is generally constant along the length of the strip 5, but has a spatial profile across the width of the strip to provide in effect a succession of opposed magnetic poles distributed across the width.

Figure 2A:
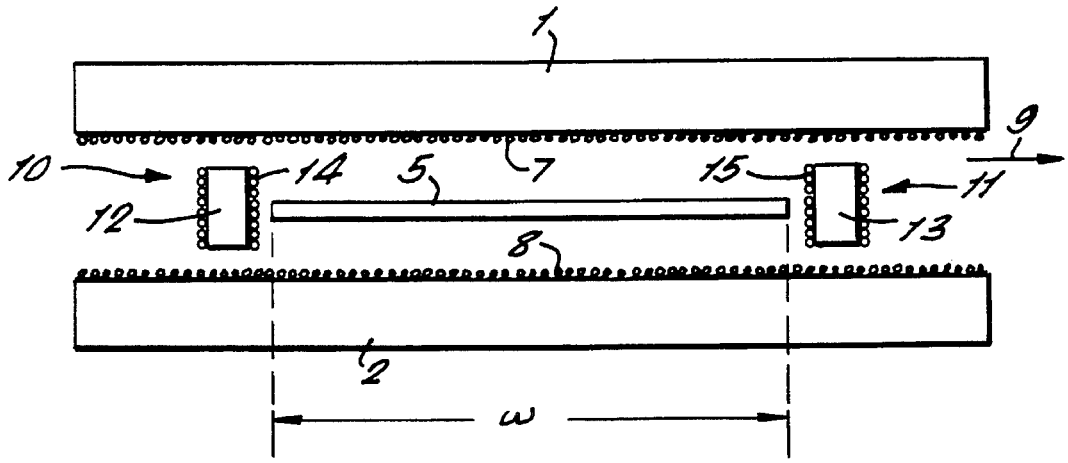
FIG. 2(*a*) is a diagramatic end view of the induction heating apparatus generating a magnetic field waveform travelling across the width of the inductor.
Figure 2B:
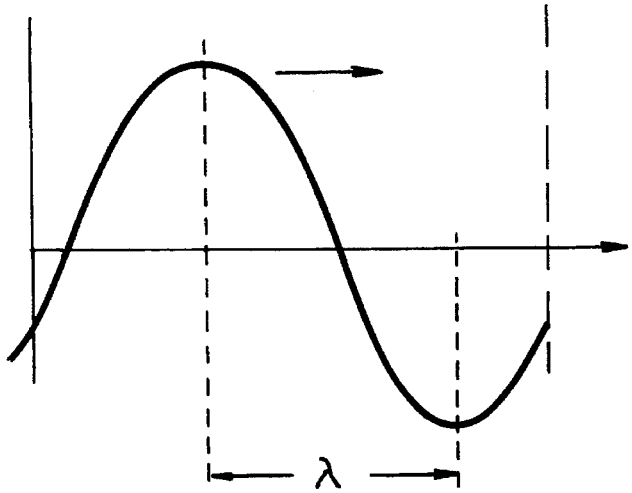

FIG. 2 shows for illustrative purposes an arrangement in which the spatial profile of magnetic field is caused to travel transversely across the width of the strip to be heated. In this arrangement the spatial profile is generally sinusoidal. Thus, in FIG. 2(*a*), the upper and lower cores 1 and 2 are shown provided with multi phase windings 7 and 8 respectively which are energised from a multi phase electrical supply so as to produce a magnetic waveform travelling across the width of a strip in the direction of arrow 9. The construction of the windings 7 and 8 and their connection to a multi phase supply may make use of such techniques known in the art of electric rotating machines.

FIG. 2(*b*) illustrates the spatial magnetic waveform produced by the windings 7 and 8 at an instant in time. This is illustrated as a substantially sinusoidal waveform of magnetic field intensity or flux density providing instantaneously opposite magnetic poles at the maximum and minimum shown in the figure. This waveform travels across the width w of the strip in the direction of the arrow.

In the illustrated arrangement, the windings 7 and S are arranged and energised to provide a spacing (or pitch) $\lambda$ across the width of the strip between adjacent maxima and minima in the instantaneous field distribution waveform. This pitch λ is selected to satisfy the equation $$w=2n\lambda$$

where w is the width of the strip 5 being heated and n is an integer. With such an arrangement, it may be seen that the provision of a sinusoidal distribution of magnetic field across the strip and a corresponding sinusoidal distribution of longitudinal eddy currents in the strip, is consistent with the total eddy current induced in the strip flowing in one direction along the length being precisely equal to the total induced eddy current in the opposite direction. If, on the other hand, the pitch λ is selected so as not to satisfy the above equation, then the requirement for the current induced in one direction to be the same as the current induced in the other direction will produce a distortion of the current density across the strip. This in turn results in a distortion of the distribution across the width of the strip of heating energy.

It should be understood at this point that selection of λ so that w=2nλ facilitates the production of uniform heating energy across the width of the strip, since it is possible to maintain a uniform amplitude sinusoidal distribution of eddy current density across the strip width. Uniform heating is then achieved in the arrangement described above where this eddy current distribution waveform travels across the strip. It may be noted that a travelling wave eddy current distribution as described corresponds to fixed cosine and sine wave current distributions having the same energising frequency but in phase quadrature.

In the above described arrangement, the sinusoidal waveform of eddy current distribution travels across the width of the strip so that the heating effect is uniform. If on the other hand the waveform is stationary across the width of the strip, then the heating energy input into the strip will also have a corresponding spatial distribution across the strip width equal to the square of the eddy current distribution waveform. Later described arrangements show how to compensate for this effect.

In practice, the magnetic field at any position across the width of the strip 5 is effected not only by the energising currents in the windings 7 and 8, but also by the presence of the strip 5 itself. Thus, the magnetic field can become distorted in the immediate vicinity of the side edges of the strip and such distortions can themselves effect the distribution of eddy currents and heating energy within the strip. Accordingly, when this is a problem, edge correction means may be provided at each side edge designed to counteract this undesirable distortion of the magnetic field profile so that the desired profile is maintained over the full width of the strip. Examples of these edge correction means are illustrated at 10 and 11 in FIG. 2(*a*) and comprise ferrite cores 12 and 13 extending along the edges of the strip 5 over the full length of the upper and lower inductors. Energising windings 14 and 15 are wound lengthwise around these cores 12 and 13 so as to generate when energised magnetic fields in the cores 12 and 13 extending vertically between the two main inductors.

In practice, the energising supplies to the windings 14 and 15 of the edge correction coils 10 and 11 are phased in relation to the supply to the main windings 7 and 8, so as to compensate appropriately for edge effects throughout the cycle of the travelling magnetic waveform. More detailed discussion will follow later herein of techniques for achieving this distortion correction and it will be appreciated that such techniques are applicable to the arrangement shown in FIG. 2.

Referring now to FIGS. 3, 4 and 5, these illustrate arrangements in which stationary magnetic field profiles are produced across the width of the strip to be heated. These figures particularly illustrate how a combination of complementary sine and cosine profiles enable a desired heat energy profile (in the described example a uniform profile) to be produced even though the profiles themselves are stationary relative to the strip.

FIG. 3(*a*) is a part view and cross-section looking through the length of the apparatus and showing the upper and lower cores 1 and 2 of the main inductors with opposed faces provided with slots 3. Windings 20 are shown located in the slots 3. This arrangement is appropriate for cores 1 and 2 made of laminated soft iron.

As can be seen, an elongate workpiece or strip 5 to be heated passes in the space 4 between the upper and lower inductors. The slots 3 extend in the direction of movement (z) of the workpiece 5 and currents flow in the windings 20 in this said direction.

All the windings are energised from a single phase alternating supply and the windings 20 are arranged, or the supply to the windings is controlled, such that the windings provide a time varying magnetic field which has an amplitude varying across the width w of the workpiece with the stationary periodic spatial profile illustrated in FIG. 3 (*b*). As can be seen, this distribution implies that there are two points or poles 21 and 22 of maximum magnetic field amplitude which are spaced apart across the width of the strip 5 by a distance λ. It can be seen that the magnetic "pole" 22 is oppositely phased to the "pole" 21, in that it has opposite magnetic field polarity to that of pole 21 at any instant in time.

FIG. 3(*c*) illustrates the current distribution in Amperes per square meter, in the metal strip 5 under the influence of the magnetic field generated by the windings 20. This distribution assumes that there are no distortions of the magnetic field at the edges of the strip 5, or else such distortions are corrected. This field also assumes that the spacing λ of the magnetic poles 21 and 22 satisfies the equation $$w=2n\lambda$$

where n is an integer. Then, as described above in relation to the travelling magnetic field embodiment, there is no need for the eddy current distribution to be distorted at the edges of the strip.

As can be seen in FIG. 3(*c*) the current distribution has a substantially sinusoidal variation. The spatial distribution may be given by Jo Cos (πx/λ) where Jo is the peak current density induced in the workpiece 5 by the field of the windings 20, and this is further modified to Jo Cos (πx/λ) Cos (ωt) to take account of the sinusoidal variation of the current density with time, where ω is the angular frequency of this supply. The power induced, in Watts per cubic meter, is proportional to the square of the current, and is consequently $Jo^2\rho \cos^2(\pi x/\lambda) \cos^2(\omega t)$ as illustrated in FIG. 3(*d*) where ρ is the resistivity of the workpiece 5.

It will be seen from FIGS. 3(*b*), (*c*) and (*d*) that, with the specified relationship between workpiece width w and magnetic pole pitch λ, and with a sinusoidal spatial variation in magnetic field B then all induced current flows are self consistent and there is no current bunching at the edges of the workpiece 5. The sinusoidal spatial variation in field is maintained right across the width of the workpiece by field modifying edge correction means at the side edges of the workpiece, as will be described in more detail later herein. Consequently, the instantaneous heat pattern, neglecting the heat transfer within the workpiece 5, is as shown in FIG. 3(*d*) with exactly half of the requisite energy having been induced in the workpiece 5. This would produce a temperature profile within the heated zones which varies sinusoidally across the workpiece 5. This pattern is substantially unchanged whether the workpiece is stationary, or moving in the z direction.

FIG. 4(*a*) illustrates an apparatus similar to that of FIG. 3(*a*), but with the windings 20 moved sideways in relation to the workpiece 5 by a distance equal to half a magnetic pole pitch (i.e. $\lambda/2$). It will, of course, be appreciated that no physical movement is necessary. All that is needed to produce the same effect electrically is to provide a second set of windings interspersed with the first set so that the electromagnetic poles produced are in the positions indicated. (Such a configuration is shown in FIG. 6).

FIG. 4(*b*) illustrates the new location of the magnetic poles as seen by the workpiece 5 from which it will be seen that while one pole is wholly within the width of the workpiece 5, the other pole is divided, a "half pole" appearing at each side edge of the workpiece.

FIG. 4(*c*) shows the current distribution, in $Am^{-2}$, in the workpiece 5 under the pole and half poles of the apparatus of FIG. 4(*a*) and in this case the amplitude is given by $Jo \sin(\pi x/\lambda) \cos(\omega t)$. Again, the sinusoidal distribution of the field across the workpiece 5 is ensured by field control at either side edge of the workpiece as will be described later. The power, in $Wm^{-3}$, induced is proportional to the square of the current as before, and is consequently $$Jo^2\rho \sin^2(\pi x/\lambda) \cos^2(\omega t)$$

as illustrated in FIG. 4(*d*).

It may thus be appreciated that the arrangement of FIG. 4 can provide the complementary half of the total energy requirement to be induced in the workpiece 5. The heated zones have, as before, temperature profiles varying sinusoidally across the workpiece. However, in this case, the half being heated is the area not heated by the FIG. 3 arrangement. The total heat input at any point x arising from the complementary nature of the two spatial heating distributions provided by the differing winding configurations is therefore:

$$Jo^2\rho \cos^2(\pi x/\lambda) \cos^2 \omega t + Jo^2\rho \sin^2(\pi x/\lambda) \cos^2 \omega t = Po \cos^2 \omega t \quad Wm^{-3}$$

where $Po = Jo^2\rho$ which is thus independent of x.

To obtain the benefit of this result, it is essential that the fields producing cosine and sine current distributions do not react with one another. FIG. 5(*a*) illustrates the current distribution (the curve labelled (sin+cos)) across the width of the workpiece if both cosine and sine windings are simultaneously energised. FIG. 5(*b*) illustrates by the curve also labelled (sin+cos) the corresponding power distribution, which is clearly highly non-uniform across the width.

In one arrangement therefore, with the above referred second winding interspersed with the first set, the workpiece is subjected in the same region to brief (≈10 ms) bursts of power from each winding for identical periods of time. This results, therefore, in the whole workpiece being provided with a uniformly distributed heat input across its width. With the two sets of windings on one core as described, it is not permissible to energise the cosine and sine windings at the same time at a common frequency and phase. It is necessary, then, to connect the windings sequentially to a single power source or to use a separate power source for each winding which itself can be switched on and off. Each winding is energised for the same length of time and this time, and the period when neither winding is energised, is dependent, inter alia, upon the heat transfer within the workpiece being heated, the degree of temperature uniformity desired, and, when a continuously moving workpiece is being heated, on the workpiece moving speed.

An alternative method of providing uniform heating is to provide two heating inductors, one behind the other, with one wound and configured to provide the cosine current generating field and the other wound and configured to provide the sine current generating field. In this case, both inductors may be continuously energised.

If the two sets of windings, the sine windings and the cosine windings, are energised at different frequencies, then both can be energised simultaneously, even if wound on the same core. Care must then be taken to adjust the relative strengths of the fields produced by the two windings to ensure the amounts of heat induced by the two fields are still spatially complementary.

The method of transverse flux induction heating described in GB-A-1546367 is largely, though not exclusively, used at frequencies below 1 kHz where the use of slotted and laminated iron core structures for the inductors is feasible. The apparatus of this invention however can be used at higher frequencies (3–20 kHz) where ferrites and more exotic magnetic materials can be used for the inductor cores.

One form of composite inductor in which the cosine winding and the sine winding are interleaved on the same ferrite core is illustrated in FIG. 6(*a*) which indicates diagrammatically the layout of the windings for a typical module, two magnetic poles wide, of a total inductor. The square boxes 23 represent the cosine winding and the round boxes 24 represent the sine winding provided on upper and lower ferrite cores 25 and 26.

The air gap MMF diagrams for both windings are shown respectively in FIGS. 6(*b*) and 6(*c*) together with the spatial variations in the current density $J_z$ which each would induce within the workpiece 5. The complementary nature of the resultant heating is clear.

To improve the sinusoidal distribution of the air gap MMF it is desirable to arrange that the centremost coils of each polar winding carry less current than the others.

The electrical connections necessary to ensure that coils 'c' and 'f' of the cosine winding 23 for example carry only half as much current as the remainder are represented in alternative ways in FIGS. 6(*d*) and 6(*e*). The remainder of the cosine winding and the sine winding are made from identical circuit modules which are suitably distributed spatially over the top and bottom inductor cores.

As is well known in electrical machine design the coils within a polar module can be all in series, all in parallel or all supplied from different sources, it is merely a question of ensuring that an appropriate distribution of ampere conductors is produced in the air gap.

There are many ways of preventing the cosine and sine windings from interacting with one another. The simplest of these merely involves connecting each winding sequentially to a single power supply. The switch involved would for most practical purposes be a thyristor switch. When the power supply is a static inverter it is convenient to incorporate the switch into the inverting circuitry producing two mutually exclusive outputs.

The applicability of the described induction heating apparatus is not limited to relatively thin workpieces as is the case with earlier transverse flux methods and, when used for slab heating, ratings of 20 MW or more must be expected. In such instances as this it is obviously a distinct advantage to build both the inductors and the power supply in a modular manner. An example of a distributed power supply concept is shown schematically in FIG. 7 and should be related to the apparatus previously described in relation to FIG. 6. Instead of the windings being connected together in a series parallel arrangement (ref. FIG. 6(*e*)) to a single inverter power supply, there are now a multiplicity of inverters ($I_1$–$I_9$, $I_a$–$I_d$) supplying each winding coil separately. All the inverters operate under the command of a remote master controller which determines the specific inverters firing at any one time and ensures synchronism between said firing inverters.

The above discussion concerns arrangements in which the amplitude of the periodic field and current distribution profiles across the width of a strip is uniform with a view to obtaining a uniform heating distribution. These arrangements have been useful in explaining the basic principles upon which are based the developments which embody examples of the present invention. However, in practice it is seldom desirable or useful to produce a precisely uniform heating effect across the width of the strip. What is required is to produce a highly predictable and controlled non-uniform heating effect across the strip width. This then can compensate for certain effects so as to ensure that the overall temperature profile of the strip is accurately controlled as required to ensure uniform or a required non-uniform thermal treatment. For example, as mentioned previously, the closing loops of eddy currents at each end of the induction apparatus produce substantial distortions of the heating effect as the strip enters the apparatus and as it leaves. By suitably tailoring the heat energy input across the width of the strip along the length of the heating apparatus, these end effects can be compensated for accurately.

The problem which is approached by the examples of the present invention now to be described is that it is inappropriate to employ magnetic field profiles and eddy current distributions according to the above referred equation $w=2n\lambda$ when non-uniform heating is required.

Regarding FIG. 8, this shows the theoretical distributions of eddy currents in the workpiece with spatial profiles supposedly meeting the requirement $w=2\lambda$. However, in this illustration, the desired heating profile P is a function of x, the distance across the width of the workpiece from the center line. P(x) is illustrated as symmetrical about the centre line but requiring increased heat energy towards the edges of the workpiece. A corresponding line is illustrated for J(x), the time averaged total eddy current density induced in the workpiece, remembering that $P \propto J^2$.

The problem arises when considering the cosine eddy current profile illustrated by the solid line. It can be seen that the integral of the current density across the width of the workpiece for the cosine distribution is no longer equal to zero. Accordingly the cosine distribution illustrated in FIG. 8 is in fact not attainable. In practice, with a magnetic field distribution intended to produce a cosine current distribution of the illustrated form, the actual current distribution achieved may be more like the dotted curve shown at 50. Not only is the maximum current density at the edge of the workpiece less than that desired, but also the current density over the centre region of the workpiece is increased. Importantly also, the zero crossing point for the current density waveform is shifted to the right so as no longer to be at the same location across the width of the workpiece as the maximum of the supposedly complementary sine current distribution waveform. Accordingly, the two current distributions actually achieved no longer constitute the sine and cosine of the same function and so are in fact no longer complementary to produce the desired $J^2(x)$ for the heat energy input.

FIG. 9 illustrates how the eddy current waveforms in the workpiece can be tailored to provide a non-uniform heating energy profile P. Considering firstly the cosine waveform 51, it can be seen that the spatial wavelength of this waveform has been slightly increased so that the crossing point 52, for zero induced current density, is now displaced slightly to the right, in the drawing, of the location (x=w/4) midway between the centre line and the side edge of the workpiece. Thus, the spacing or pitch λ between adjacent maxima and minima of the waveform is now greater than W/2. The amount by which λ exceeds W/2 is chosen so that the integral of the current density between the crossing point 52 and the neighbouring edge of the workpiece is equal to the integral of the current density between the crossing point 52 and the centre line of the workpiece. Thus, the pitch λ of the waveform is selected to satisfy the condition that the integral of the current density right across the workpiece is still zero, even though the amplitude of the cosine waveform now varies as a symmetric function of x, in fact increasing from the centre line of the workpiece towards the edges.

Having selected the appropriate value for λ for the cosine waveform, it is then relatively straight forward to form the complementary sine waveform with the same value λ and having an appropriate amplitude corresponding to J(x).

The two waveforms representing the complementary current densities can be represented as $$J(x)\ \mathrm{Cos}\ \phi(x) \text{ and } J(x)\ \mathrm{Sin}\ \phi(x).$$

In this example, the function $\phi(x)$ is of the form $\pi x/\lambda$, where λ is chosen to have a value greater than w/2 as illustrated in the figure. The selection of the value for λ in the present example, and more generally of the function $\phi(x)$ is made to satisfy the requirement that the integral of current density right across the width of the workpiece is zero. This may be expressed by the equation $$\int_{-w/2}^{w/2} J(x)\, e^{j\phi(x)}\, dx = 0. \tag{1}$$

Clearly, the resulting heat energy input from the two cosine and sine current density waveforms referred to above is given by $$P(x)=J^2(x)(\mathrm{Cos}^2\ \phi(x)+\mathrm{Sin}^2\ \phi(x)).$$

Thus, $P(x)=J^2(x)$ as required.

It is, thus, an important feature of one aspect of the present invention that the magnetic field generating means of the induction heating apparatus is arranged for generating fields which produce corresponding cosine and sine eddy current distributions, even when it is desired that J (or the mean heating energy developed in the workpiece) is non-uniform across the width of the workpiece. As explained above, in order to achieve this, the function $\phi(x)$ must be carefully selected. For a simple non-uniform J (or P) which is symmetrical about the centre line of the workpiece, it may be satisfactory for $\phi$ to be a linear function of x, so that the waveform of the spatial current distribution has a constant pitch or half wavelength, herein called λ. However, to provide a desired non-linearity of J or P, w will not be equal to 2nλ, n being a positive integer. If $w=2n\lambda$, then it is possible to produce only a constant value for J or P across the width of the workpiece, assuming the magnetic field is not distorted by edge effects.

Further, in order to produce a non-uniform J, the magnetic field generating means must be capable of producing a magnetic field profile across the width of the workpiece having a spatial waveform which varies in amplitude.

Some examples will now be described of coil winding and switching arrangements for the magnetic field generating means, which will enable the production of these fields required for non-uniform J.

Referring firstly again to FIG. 7, the arrangement illustrated may be modified to enable the output voltage/current of each inverter, along with the selection and number of coils connected to it, to be separately controlled from the master controller. The switching arrangements which would be required for connecting the inverters to selected coils are not shown in the figure. It may however be appreciated that an arrangement of this kind will enable the number of ampere turns produced to be fully controlled anywhere across the width of the inductor, so that magnetic field profiles could be produced to provide the required eddy current distributions as described above to produce a non-uniform J.

In practice, the procedure for determining the distribution of ampere turns across the width of the inductor may be as follows. Firstly, the ideal heat input profile for the workpiece is determined. This may depend on the shape of the workpiece, estimates of heat loss from the workpiece, the distortions to heat input as the workpiece enters and leaves the induction heating apparatus, as well as other factors. From this heating input profile (P(x)), it is possible to calculate the ideal average current density profile. If conductivity of the workpiece is taken to be uniform across the width of the workpiece, then the current density profile J(x) is proportional to the square root of P(x).

Next, the complementary cosine and sine current density profiles are determined, by selecting the function $\phi(x)$ giving the complementary profiles $$J(x)\ \mathrm{Cos}\ \phi(x) \text{ and } J(x)\ \mathrm{Sin}\ \phi(x)$$

which each satisfy the requirement that there is no net current flowing along the length of the workpiece.

For a simple symmetrical function J, $\phi$ may be a linear function of x e.g. $\phi=\pi x/\lambda+\alpha$, where $\alpha$ is a constant. Then equation 1 becomes $$0=\int_{-w/2}^{w/2} J(x)\ \{\mathrm{Cos}\pi x/\lambda\ \mathrm{Cos}\alpha-\mathrm{Sin}\pi x/\lambda\ \mathrm{Sin}\alpha\}\ dx \tag{2}$$

and $$0=\int_{-w/2}^{w/2} J(x)\ \{\mathrm{Cos}\pi x/\lambda\ \mathrm{Sin}\alpha-\mathrm{Sin}\pi x/\lambda\ \mathrm{Cos}\alpha\}\ dx. \tag{3}$$

Since J(x) is symmetrical, $$\int_{-w/2}^{w/2} J(x)\ \mathrm{Sin}\ \pi x/\lambda\ dx \text{ is always zero.}$$

Then both equations 2 and 3 become $$0=\int_{-w/2}^{w/2} J(w)\ \mathrm{Cos}\ \pi x/\lambda\ dx \tag{4}$$

This means that for symmetrical functions of J, $\alpha$ can be chosen to suit other considerations or may be zero. Equation 4 can then be solved for $\lambda$ given any particular simple symmetrical function J.

A graphical illustration of a solution is given in FIG. 9, where $\lambda$ may be approximately 0.55 w. There may be several solutions for x generally of the form $$\lambda=w/2n\pm\delta_n,$$

where $\delta_n$ is different for each integer n.

Having determined the function $\phi$ the ideal eddy current density distributions for the two complementary fields can be calculated from J(x) Cos$\phi$(x) and J(x) Sin$\phi$(x).

It is then necessary to calculate the resultant magnetic field which must exist to induce each of these spatial distributions of current density. This computed resultant field is due to the currents flowing in the windings of the inductor of the induction heating apparatus and the currents induced in the workpiece itself. The currents in the workpiece have already been calculated and so the magnetic field produced by these currents can also be calculated. It is then possible to subtract this latter magnetising field from the pro-calculated resultant magnetising field and arrive at the magnetising field distribution which must be produced by the inductor. From this it is possible to calculate the distribution of currents or ampere turns which must be provided at each location across the width of the inductor to produce the calculated inductor field.

The magnetic field generating means is then controlled to produce these fields, either simultaneously at different frequencies or in phase quadrature, or alternately in time.

When the fields are produced alternately in time, the duration of each of the fields may not be identical, but have a ratio $\kappa=t_s/t_c$ where $t_s$ is the duration of the sine field and $t_c$ is the duration of the cosine field. Then the time averaged amplitudes of the sine and cosine eddy current distributions should be J(x) for the cosine distribution and $\sqrt{\kappa}$ J(x) for the sine distribution. These values imply actual amplitudes when the respective distributions are present of $(\kappa-1)$J(x) for the cosine distribution and $((\kappa+1)/\sqrt{\kappa})$ J(x) for the sine distribution. The heating powers dissipated by each of these distributions correspond to $$(\kappa+1)^2\ J^2(x)\ \mathrm{Cos}^2\ \phi(x) \text{ and } ((\kappa+1)^2/\kappa)\ J^2(x)\ \mathrm{Sin}^2\ \phi(x).$$

The time averaged powers corresponding to these are $$(\kappa+1)\ J^2(x)\ \mathrm{Cos}^2\ \phi(x) \text{ and } (\kappa+1)\ J^2(x)\ \mathrm{Sin}^2\ \phi(x).$$

Thus the sum is $(\kappa+1)\ J^2(x)$. Accordingly J(x) is $1/\sqrt{(\kappa+1)}$ times the magnitude of induced current density required to produce the desired heating profile P(x).

In such cases where the repeat period $t_p$ for each of the fields is not equal to $t_s+t_c$ (i.e. the fields are generated simultaneously for part of the time, or else there is an interval when neither field is generated), the above calculations show that J(x) is $\sqrt{(t_c/t_p)}$ times the magnitude of induced current density required to produce the desired heating profile P(x).

In order to produce the desired magnetic field profiles from the same inductor arrangement in the heating apparatus, it may be important to be able to alter the effective pitch (or spacing between adjacent maxima and minima of magnetic field) to suit different functions $\phi$, and in particular different values for $\lambda$. An arrangement for achieving this using conventional doublelayer continuous coil windings will now be described. Such double layer winding arrangements are familiar from three phase motor constructions.

A typical 2 pole module of a double layer linear winding is shown schematically in FIGS. 10(*b*) and 10(*a*). All the coils have the same pitch of 5 'slots' (or 'stations' in an unslotted arrangement). Thus, the start of coil 6 and the finish of coil 1 share the same x wise location on say the top inductor. Conditions on the bottom inductor would be identical or of exactly opposite polarity depending on the philosophy of operation. Each coil can be connected by a series of thyristor switches to a centre tapped single phase AC supply. With coils 1–6 connected to one bus bar and coils 7–12 to the other, the 2 pole modular winding gives rise to the MMF spatial waveform 27 shown in FIG. 10(*c*). If coils 1–3 and 7–9 are switched to the opposite bus bar as shown in FIGS. 10(*d*) and 10(*e*) then the MMF wave 28 is created.

By suitably synchronising this switching strategy it is possible to keep synthesising SINE and COSINE distributions sequentially from the same basic 12 coils. With the sample switching regime illustrated in FIG. 10, the winding can be seen to produce a field having a magnetic pole pitch of say 6 cm.

FIG. 11 shows that the same twelve coils as shown in FIG. 10 can be 'reconnected' by a different switching regime to give a winding with a magnetic pole pitch of 5 cm. By varying the voltages applied to successive coils it is possible to synthesise pole pitches of intermediate size.

A typical set of test results are shown in FIG. 12 to show how the heating intensity may vary spatially in an apparatus embodying the invention. The workpiece in this case was 1.5 mm stainless steel strip.

It is apparent from the profiles of Figure that there is an 'end effect' in the z direction where the workpiece emerges from the inductors. This arises where the eddy current paths close naturally on themselves in such a way as to minimise energy loss rather than to preserve the carefully created thermal profiles. Such a distribution is shown in FIG. 13 and obviously affects the local thermal profiles. This is particularly noticeable at say point P in FIG. 12. To reduce this effect additional voltages can be induced in the workpiece outside the inductors so that the natural paths of current flow are modified to produce an acceptably uniform heating. A schematic representation of this is illustrated in FIG. 13.

If the workpiece is sufficiently thick it is possible to reduce these end effects at source merely by reversing the magnetic field on the bottom inductor relative to the top inductor. This reversal of facing poles results in the eddy currents flowing down the workpiece on the topside and returning on the underneath. This scheme is particularly appropriate for finite length workpieces as opposed to continuous strip workpieces.

It has been mentioned above that both the sine and cosine magnetic fields may be energised simultaneously at the same frequency provided they induce currents in different regions of the workpiece. In a previously described example, the fields are applied at different regions along the length of the workpiece, so that the total heating power applied to the workpiece as the workpiece travels through the apparatus is summed to provide the desired profile across the width.

In the case of a workpiece of sufficient thickness, it is also possible to apply the sine and cosine current generating magnetic fields simultaneously to opposite sides of the workpiece. The limiting factor is that the fields generated by the upper and lower inductors do not penetrate more than halfway through the thickness of the workpiece. With this arrangement, the sine and cosine heat distributions are produced respectively in the upper and lower surfaces of the workpiece which with heat transfer within the workpiece, can result in the desired overall heating profile across the width of the workpiece.

It has been explained previously above that it can be useful to correct for edge effects at the side edges of the workpiece being heated unless the workpiece is electrically thin stainless steel for example. In the absence of any correction, the magnetic field profile can be distorted in the edge region, which in turn can result in uncorrected distortion of the intended current profiles flowing in the workpiece. One philosophy of edge correction is to achieve an arrangement whereby the finite width workpiece is linked across its entire width by exactly the same flux distribution as would link a comparable piece of material from within a similar workpiece of infinite width.

To understand how edge correction may be achieved, it is easiest to consider the trivial cases of edge correcting a cosine current generating field and a sine current generating field where $\phi=2\pi nx/w$, (i.e. $w=2n\lambda$). Then the cosine generating field is such as to generate a current profile across the width which has a current maximum at the edges of the workpiece. By comparison a sine current generating field then has a zero current at the workpiece edges.

FIG. 14 illustrates an ideal solution for such a trivial cosine current field. At an edge in plane F of the workpiece 5, heated by upper and lower windings 30 and 31 respectively on upper and lower cores 32 and 33, a ferrite block 34 is located as close as possible to the edge F and bridging the gap between the upper and lower cores 32 and 33. Since the ferrite block 34 has a magnetic permeability tending to infinity, the magnetic flux lines of the field generated by the windings emerge normal to the face of the ferrite block 34 along the line of the plane F. This corresponds to the boundary condition of the ideal infinitely wide cosinusoidal field profile at this location (i.e. the field that appears midway between planes I and K within the width of the workpiece).

By comparison, FIG. 15 illustrates the edge correction in the case of the trivial sine current generating field. Here in the ideal case of the sinusoidal field distribution across the width of the workpiece, the flux lines at the edge now in plane G are precisely normal to the plane of the workpiece. To create an equivalent field shape, in the presence of the edge on plane G, windings are provided around the ferrite block 34 substantially parallel to the plane of the workpiece 5 to generate additional fields as illustrated in the drawing. For this purpose, it is necessary to move the ferrite block 34 a small distance away from the edge of the workpiece so as to accommodate the windings. However, it is then possible to distribute the winding 35 around the ferrite block 34 and arrange for energising currents in it which produce a magnetic field all along the plane G which corresponds to that which would appear at this plane if the strip and the inductor were of infinite width (i.e. the field that appears at the plane K within the width of the workpiece).

In the case of interspersed or switched windings which alternately produce sine and cosine fields, the correction winding 35 is switched on and off in synchronism to provide appropriate correction.

Because the ferrite block 34 is moved slightly away from the edge of the workpiece, to accommodate the winding 35, a slight error is produced in the correction of the cosine current distribution. FIG. 16 illustrates how this may be itself corrected by additional coils 36 located in the air gap on either side of the edge of the workpiece. Appropriate energisation of these coils, can reinstate the desired field profile with flux lines precisely perpendicular to the plane F at the edge of the workpiece during the production of cosine fields from the main windings.

Again the additional coils 36 are switched off during the correction of the sine fields.

It will appreciated that corresponding correction is carried out at the opposite side edge of the workpiece. Also, in the case of side edges located at intermediate positions in the waveform of the magnetic field profiles generated by the main windings, corresponding devices and coils may be designed to ensure that the boundary condition of the magnetic field over the plane containing the edge of the workpiece is maintained. Still further, in the case of travelling wave fields as disclosed above, it will be appreciated that a time varying corrective field may be provided at the side edges to ensure the boundary conditions are maintained throughout the cycle of the travelling field.

To provide the fullest possible flexibility in the inductors so that they can synthesise a wide range of field profiles as required for non-uniform J, it is convenient to form the inductors with an array of electrical conductors extending in a plane parallel to the workpiece. Switching arrangements are required to enable any one of the conductors to be connected either way across the alternating current supply. Further, there should be provision for adjusting the number of ampere turns provided by the conductors per unit width (x) across the workpiece. This may be achieved for example by connecting immediately adjacent conductors in parallel to increase ampere turns locally, and by reducing the number of conductors connected across the supply where it is required to reduce the local ampere turns. It is of course, desirable if a conductor in one location across the width of the workpiece can be connected in series with a conductor at another location to carry the return current back to the same end of the inductor. All the available conductors can then be suitably interconnected with immediately adjacent conductors carrying opposing currents at locations where it is required to produce lower levels or zero magnetic field.

Alternatively, or in addition to the above arrangements, provision may be made for adjusting the level of current flowing along individual conductors, again with a view to synthesising the desired magnetic field profile.

A schematic representation of a comprehensive switching and control arrangement for individual conductors is illustrated in FIG. 17. Here, a single source of alternating current 50 can be connected by means of thyristor switches 51 and 52 alternately between a common bus bar 53 and one of sine and cosine bus bars 54 and 55. The thyristors 51 and 52 are controlled to alternate the generation of the magnetic fields corresponding to the cosine and sine eddy current distributions.

The rest of FIG. 17 illustrates the switching arrangement to individual conductors 56 of an inductor for generating the magnetic fields for forming the sine distribution of eddy currents in the workpiece. Thus, each conductor 56 can be connected between the sine bus 54 and the common bus 53 by means of a switching arrangement 57. Looking at the right hand conductor 56 and switching arrangement 57 illustrated in FIG. 17, the contacts of the switch 57 identified as a and e enable either end of the conductor 56 to be connected to the common bus 53. Contacts b and f enable the sine supply bus 54 to be connected to either end of the conductor 56. Terminals c and g enable either end of the conductor 56 to be connected to the sine supply bus 54 via an adjustable inductance 58, whereby the current produced in the conductor 56 can be adjusted. Terminal d allows one end of the conductor 56 to be connected to an opposite end of an adjacent conductor 56. A similar contact might be provided for connecting adjacent ends of adjacent conductors together.

The illustrated switching arrangements can provide full flexibility in synthesising the desired magnetic field distribution across the width of the inductor and the corresponding workpiece. It should be understood that a corresponding set of switches and separate conductors would be required for connection to the Cos supply bus 55 to generate the cosine field distribution.

A simpler switching and control arrangement for conductors of an inductor is illustrated in FIG. 18. Here, it is assumed that the coils 60 are of sufficiently high impedance that any series interconnections are unnecessary. In the arrangement illustrated, each conductor 60 can be connected by thyristor switches 61, 62, 63 and 64 in either polarity between supply buses 65 and 66 from a common AC supply 67. In each case, the current delivered to the conductor 60 can be adjusted, either by means of a variable transformer 68 as illustrated on the left hand side of FIG. 18, or by means of a series connected variable inductance 69 as illustrated on the right hand side in the figure.

By this arrangement, the polarity and amplitude of AC current in each of the inductors can be independently controlled substantially instantaneously, and importantly, whilst the inductors are on load. Both the sine and cosine profiles can be generated from the same conductors 60 by means of this system, simply by selecting appropriate switching patterns.

In summary, the described embodiments of the present invention enable appropriate cosine and sine eddy current distributions to be produced in a workpiece to provide a desired non-uniform total eddy current density distribution across the workpiece width. In the described arrangements, this is achieved by ensuring that adequate switching and/or current control provisions are made so that the ampere turns delivered by the inductors can be suitably profiled across the width of the workpiece in accordance with the design criteria and philosophy described above.

In the simple examples described above, symmetrical non-uniform heating profiles have been considered which can be synthesised from linear functions $\phi$. In general, however, more complex and in particular non-symmetric heating profiles may also be synthesised by appropriate calculation and selection of functions $\phi$. In such cases, the functions $\phi$ may be non-linear functions of x. The only limitation to the shape of heating profile that can be produced is the degree to which the required magnetic field profiles can be synthesised in practice. For example, it may be impracticable to generate magnetic field profiles with sharp spatial transitions or discontinuities. Nevertheless, the arrangements described with suitable modification may be used to provide desired non-uniform heat input profiles to workpieces. This may be highly desirable for example when heating profiled workpieces having non-uniform thickness across their width, and/or treating material having a variable electrical conductivity across the width due say to substantial thermal gradients therein.

I claim:

1. Induction heating apparatus for heating an elongate meal workpiece of predetermined width w, comprising means to generate time varying magnetic fields having magnitudes with spatial profiles across the width w of the workpiece which respectively correspond to time averaged longitudinal eddy current distributions in the workpiece having distributions across the width of the workpiece which are substantially:

$$J(x)\ \mathrm{Cos}\ \phi(x) \text{ and } \sqrt{\kappa}J(x)\ \mathrm{Sin}\ \phi(x)$$

where x is the distance across the width of the workpiece from the center line,

J(x) is proportional to the magnitude of induced current density in the workpiece at a distance x from the center line required to produce a desired profile P(x) across the width w of heat energy generated in the workpiece, $\kappa$ is the ratio of the time for which said field corresponding to said sine eddy current distribution is generated relative to the time for which said field corresponding to said cosine eddy current distribution is generated, and $\phi(x)$ is a function of x selected such that in substance $$\int_{-w/2}^{w/2} J(x)e^{j\phi(x)}dx = 0;$$

and means for controlling said magnetic field generating means to generate said fields with said corresponding eddy current distributions for which J is non-uniform.

2. Apparatus as claimed in claim 1 wherein said magnetic field generating means generates said respective fields simultaneously at different energising frequencies.

3. Apparatus as claimed in claim 2 wherein said magnetic field generating means generates said respective magnetic fields over the same region of a workpiece.

4. Apparatus as claimed in claim 2 for heating a workpiece of a predetermined thickness such that magnetic fields in opposite broad faces do not interact wherein both of said respective fields are generated over one broad face of said workpiece and said magnetic field generating means is arranged to generate corresponding further said respective fields over the other broad face of said workpiece at the same location along the length of the workpiece, said corresponding further fields being generated simultaneously with said respective fields over the one face to have corresponding eddy current distributions across the width of the workpiece which are in time antiphase to the eddy currents produced in said one face.

5. Apparatus as claimed in claim 1 wherein said magnetic field generating means generates said respective fields simultaneously at the same energising frequency but in phase quadrature.

6. Apparatus as claimed in claim 1 wherein said magnetic field generating means generates said respective fields successively in time.

7. Apparatus as claimed in claim 1 wherein said respective fields are generated alternately.

8. Apparatus as claimed in claim 1 wherein said magnetic field generating means generates said respective magnetic fields simultaneously at the same energising frequency and phase, but over spaced apart regions of a workpiece so that said fields do not interact.

9. Apparatus as claimed in claim 8, wherein said regions are longitudinally spaced along the workpiece.

10. Apparatus as claimed in claim 8, wherein said regions are on opposite sides of a workpiece of sufficient thickness that the fields do not interact.

11. Induction heating apparatus as claimed in claim 1 and including transport means for moving a workpiece lengthwise past said magnetic field generating means.

12. Induction heating apparatus as claimed in claim 1 wherein said magnetic field generating means comprises electric current conductors aligned to be longitudinal relative to the workpiece and arranged in a parallel array across the workpiece width, and means for selectively connecting said conductors to a source of time varying current whereby the current in the conductors is selected to produce said respective magnetic fields.

13. Induction heating apparatus as claimed in claim 12, wherein said selectively connecting means is arranged for connecting selected said conductors in series.

14. Induction heating apparatus as claimed in claim 13, wherein said selectively connecting means is arranged for connecting together corresponding ends of selected pairs of said conductors to form respective single coil windings.

15. Induction heating apparatus as claimed in claim 12 wherein said means for selectively connecting includes adjustment means for adjusting the relative currents arranged to flow in the conductors.

16. Induction heating apparatus as claimed in claim 15 wherein said plurality of sources comprise sources of the same frequency but in phase quadrature.

17. Induction heating apparatus as claimed in claim 12 wherein said magnetic field generating means includes a plurality of sources of time varying current and said selectively connecting means is arranged for connecting said conductors selectively to said sources.

18. Induction heating apparatus as claimed in claim 17, wherein said plurality of sources comprise sources of different magnitude of current.

19. Induction heating apparatus as claimed in either of claims 15 to 17, wherein said plurality of sources comprise sources of different frequency.

20. Induction heating apparatus for heating an elongate meal workpiece of predetermined width w, comprising means to generate time varying magnetic fields having magnitudes with spatial profiles across the width w of the workpiece which respectively correspond to time averaged longitudinal eddy current distributions in the workpiece having distributions across the width of the workpiece which are substantially:

$$J(x)\ \mathrm{Cos}\ \phi(x) \text{ and } \sqrt{\kappa}J(x)\ \mathrm{Sin}\ \phi(x)$$

where x is the distance across the width of the workpiece from the center line,

J(x) is proportional to the magnitude of induced current density in the workpiece at a distance x from the center line required to produce a desired profile P(x) across the width w of heat energy generated in the workpiece, $\kappa$ is the ratio of the time for which said field corresponding to said sine eddy current distribution is generated relative to the time for which said field corresponding to said cosine eddy current distribution is generated, and $\phi(x)$ is a function of x selected such that in substance $$\int_{-w/2}^{w/2} J(x)e^{j\phi(x)}dx = 0;$$

and means for controlling said magnetic field generating means to generate said respective fields successively in time.

21. Induction heating apparatus for heating an elongate meal workpiece of predetermined width w, comprising means to generate time varying magnetic fields having magnitudes with spatial profiles across the width w of the workpiece which respectively correspond to time averaged longitudinal eddy current distributions in the workpiece having distributions across the width of the workpiece which are substantially:

$$J(x)\ \mathrm{Cos}\ \phi(x) \text{ and } \sqrt{\kappa}J(x)\ \mathrm{Sin}\ \phi(x)$$

where x is the distance across the width of the workpiece from the center line,

J(x) is proportional to the magnitude of induced current density in the workpiece at a distance x from the center line required to produce a desired profile P(x) across the width w of heat energy generated in the workpiece, and $\phi(x)$ is a function of x selected such that in substance $$\int_{-w/2}^{w/2} J(x)e^{j\phi(x)}dx = 0;$$

said magnetic field generating means having a first part arranged to generate a first of said respective fields and a second part arranged to generate a second of said respective fields simultaneously at the same energizing frequency and phase as said first field, said first and second parts being spaced apart to generate said respective fields over spaced apart regions of a workpiece so that said fields do not interact.

22. A method of heating by induction an elongate metal workpiece of predetermined with w, comprising the steps of generating time varying magnetic fields having magnitudes with spatial profiles across the width w of the workpiece which respectively correspond to time averaged longitudinal eddy current distributions in the workpiece having distributions across the width of the workpiece which are substantially:

$$J(x)\ \mathrm{Cos}\ \phi(x) \text{ and } \sqrt{\kappa}J(x)\ \mathrm{Sin}\ \phi(x)$$

where x is the distance across the width of the workpiece from the center line,

J(x) is proportional to the magnitude of induced current density in the workpiece at a distance x from the center line required to produce a desired profile P(x) across the width w of heat energy generated in the workpiece, $\kappa$ is the ratio of the time for which said field corresponding to said sine eddy current distribution is generated relative to the time for which said field corresponding to said cosine eddy current distribution is generated, and $\phi(x)$ is a function of x selected such that in substance $$\int_{-w/2}^{w/2} J(x)e^{j\phi(x)}dx = 0;$$

and controlling the generation of said fields to have said corresponding eddy current distributions in which J is non-uniform.

23. A method as claimed in claim 22 wherein said respective fields are generated simultaneously at different energizing frequencies.

24. A method as claimed in claim 23 wherein said respective magnetic fields are generated over the same region of a workpiece.

25. A method as claimed in claim 23 for heating a workpiece of a predetermined thickness such that magnetic fields in opposite broad faces do not interact, wherein both of said respective fields are generated over one broad face of said workpiece and the method includes the further step of generating corresponding further said respective fields over the other broad face of said workpiece at the same location along the length of the workpiece, said corresponding further fields being generated simultaneously with said respective fields over the one face to have corresponding eddy current distributions across the width of the workpiece which are in time antiphase to the eddy currents produced in said one face.

26. A method as claimed in claim 22 wherein said respective fields are generated simultaneously at the same energizing frequency but in phase quadrature.

27. A method as claimed in claim 22 wherein said respective fields are generated successively in time.

28. A method as claimed in claim 22 wherein said respective fields are generated alternately.

29. A method as claimed in claim 22 wherein said respective magnetic fields are generated simultaneously at the same energizing frequency and phase, but over spaced apart regions of a workpiece so that said fields do not interact.

30. A method as claimed in claim 29, wherein said regions are longitudinally spaced along the workpiece.

31. A method as claimed in claim 29, wherein said regions are on opposite sides of a workpiece of sufficient thickness that the fields do not interact.

32. A method as claimed in claim 22 including the step of moving a workpiece lengthwise past said magnetic field generating means.

33. A method of heating by induction an elongate metal workpiece of predetermined width w, comprising generating time varying magnetic fields having magnitudes with spatial profiles across the width w of the workpiece which respectively correspond to time averaged longitudinal eddy current distributions in the workpiece having distributions across the width of the workpiece which are substantially:

$$J(x)\ \mathrm{Cos}\ \phi(x) \text{ and } \sqrt{\kappa}J(x)\ \mathrm{Sin}\ \phi(x)$$

where x is the distance across the width of the workpiece from the center line,

J(x) is proportional to the magnitude of induced current density in the workpiece at a distance x from the center line required to produce a desired profile P(x) across the width w of heat energy generated in the workpiece, $\kappa$ is the ratio of the time for which said field corresponding to said sine eddy current distribution is generated relative to the time for which said field corresponding to said cosine eddy current distribution is generated, and $\phi(x)$ is a function of x selected such that in substance $$\int_{-w/2}^{w/2} J(x)e^{j\phi(x)}dx = 0;$$

wherein said respective fields are generated successively in time.

34. A method of heating by induction an elongate metal workpiece of predetermined width w, comprising generating time varying magnetic fields having magnitudes with spatial profiles across the width w of the workpiece which respectively correspond to time averaged longitudinal eddy current distributions in the workpiece having distributions across the width of the workpiece which are substantially:

$$J(x)\ \mathrm{Cos}\ \phi(x) \text{ and } J(x)\ \mathrm{Sin}\ \phi(x)$$

where x is the distance across the width of the workpiece from the center line,

J(x) is the magnitude of induced current density in the workpiece at a distance x from the center line required to produce a desired profile P(x) across the width w of heat energy generated in the workpiece, and $\phi(x)$ is a function of x selected such that in substance $$\int_{-w/2}^{w/2} J(x)e^{j\phi(x)}dx = 0;$$

wherein said respective fields are generated simultaneously at the same energizing frequency and phase, but over spaced apart regions of a workpiece so that said fields do not interact.

* * * * *